US007859494B2

(12) United States Patent
Choi et al.

(10) Patent No.: US 7,859,494 B2
(45) Date of Patent: Dec. 28, 2010

(54) DISPLAY DEVICE AND DRIVING METHOD THEREOF

(75) Inventors: Joon-Hoo Choi, Seoul (KR); Jong-Moo Huh, Gyeonggi-do (KR); In-Su Joo, Seongnam-si (KR); Chun-Seok Ko, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 1060 days.

(21) Appl. No.: 11/028,356

(22) Filed: Jan. 3, 2005

(65) Prior Publication Data

US 2005/0179625 A1 Aug. 18, 2005

(30) Foreign Application Priority Data

Jan. 2, 2004 (KR) ..... 10-2004-0000028
Nov. 16, 2004 (KR) ..... 10-2004-0093562
Nov. 22, 2004 (KR) ..... 10-2004-0095790

(51) Int. Cl.
*G09G 3/32* (2006.01)

(52) U.S. Cl. ..... 345/82; 345/207

(58) Field of Classification Search ..... 345/76–78, 345/82–84, 98, 207
See application file for complete search history.

(56) References Cited

U.S. PATENT DOCUMENTS 6,380,689 B1 * 4/2002 Okuda ..... 315/169.3
6,750,833 B2 * 6/2004 Kasai ..... 345/76
7,026,597 B2 * 4/2006 Cok ..... 250/214 AL
7,038,392 B2 * 5/2006 Libsch et al. ..... 315/169.3
7,148,868 B2 * 12/2006 Lee ..... 345/87
2002/0084463 A1 * 7/2002 Sanford et al. ..... 257/82
2003/0151569 A1 * 8/2003 Lee et al. ..... 345/84
2003/0227262 A1 * 12/2003 Kwon ..... 315/169.3
2004/0222954 A1 * 11/2004 Lueder ..... 345/87
2005/0007321 A1 * 1/2005 Schuler ..... 345/82

* cited by examiner

*Primary Examiner*—Quan-Zhen Wang
*Assistant Examiner*—Calvin C Ma
(74) *Attorney, Agent, or Firm*—Cantor Colburn LLP

(57) ABSTRACT

A display device is provided, which includes: a light emitting element; a storage capacitor; a driving transistor supplying driving current to the light emitting element to emit light; a first switching transistor applying a data voltage to the driving transistor and the storage capacitor in response to a first scanning signal, a light sensor sensing amount of light according to the light emission of the light emitting element and generates a sensing signal depending on the sensed light amount; and a signal controller determining luminance corresponding to the sensing signal, comparing the determined luminance and a target luminance corresponding to the data voltage, and modifies an image signal.

19 Claims, 22 Drawing Sheets

DISPLAY DEVICE AND DRIVING METHOD THEREOF

BACKGROUND OF THE INVENTION (a) Field of the Invention

The present invention relates to a display device and a driving method thereof.

(b) Description of Related Art

Recent trends of light-weighted and thin personal computers and televisions sets also require light-weighted and thin display devices, and flat panel displays satisfying such a requirement is being substituted for conventional cathode ray tubes (CRT).

The flat panel displays include a liquid crystal display (LCD), field emission display (FED), organic light emitting display (OLED), plasma display panel (PDP), and so on.

Generally, an active matrix flat panel display includes a plurality of pixels arranged in a matrix and displays images by controlling the luminance of the pixels based on given luminance information. An OLED displays image by electrically exciting light emitting organic material, and it is a self-emissive display device having low power consumption, wide viewing angle, and fast response time, thereby being advantageous for displaying motion images.

A pixel of an OLED includes a light emitting element and a driving thin film transistor (TFT). The TFT includes polysilicon or amorphous silicon. A polysilicon TFT has several advantages, but it also has disadvantages such as the complexity of manufacturing polysilicon, thereby increasing the manufacturing cost. In addition, it is hard to make an OLED employing polysilicon TFTs be large.

On the contrary, an amorphous silicon TFT is able to make a large OLED and to facilitate the manufacturing process. However, an OLED employing amorphous silicon TFTs exhibit a deterioration of bias stress stability that an output current of the TFT is reduced as time goes under a long-time application of high DC control voltages with high driving voltages such that the luminance is varied for a given data voltage. In addition, since the driving transistor and the light emitting element are connected to each other, a node voltage varies depending on the data voltage, which should be substantially constant. That is, the node voltage increases as the data voltage increases and thus a range of control voltages of the driving transistor is small compared with the data voltage. Accordingly, the data voltages are not efficiently used.

SUMMARY OF THE INVENTION

A motivation of the present invention is to solve the problems of conventional techniques.

A display device is provided, which includes: a light emitting element; a storage capacitor; a driving transistor supplying driving current to the light emitting element to emit light; a first switching transistor applying a data voltage to the driving transistor and the storage capacitor in response to a first scanning signal, a light sensor sensing amount of light according to the light emission of the light emitting element and generates a sensing signal depending on the sensed light amount; and a signal controller determining luminance corresponding to the sensing signal, comparing the determined luminance and a target luminance corresponding to the data voltage, and modifies an image signal.

The display device may further include a second switching transistor applying a reverse bias voltage to the driving transistor and the capacitor in response to a second scanning signal before the data voltage is applied to the driving transistor.

The display device may further include a third switching transistor disconnecting the driving transistor to a driving voltage according to an inversion signal during the application of the data voltage to the driving transistor.

The display device may further include an inversion unit applying the inversion signal to the third switching transistor, wherein the inversion signal is reversed to the first scanning signal.

The inversion unit may include: a first transistor having a control terminal and an input terminal that are connected to a gate-on voltage and an output terminal connected to the third switching transistor; and a second transistor having a control terminal connected to the first scanning signal, an input terminal connected to the second scanning signal, and an output terminal connected to the third switching transistor.

The display device may further include first and second scanning signal transmitting the first and the second scanning signals, respectively, wherein the second scanning signal is previous to the first scanning signal.

The first and the second scanning signals may include a plurality of gate-on voltages.

The reverse bias voltage may have negative polarity.

The light sensing unit may include: a sensing transistor sensing amount of light according to the light emission of the light emitting element and generating photo current; and a fourth switching transistor outputting a sensing signal according to the photo current.

The fourth switching transistor may output the sensing signal in response to the first scanning signal.

The light sensing unit may further include a sensor capacitor storing electrical charges depending on the photo current to generate the sensing signal.

The signal controller may include: a lookup table storing luminance information corresponding to the sensing signal; and a data modifier reading the luminance information from the lookup table to determine the luminance corresponding to the sensing signal, comparing the determined luminance and a target luminance corresponding to the data voltage, and modifies an image signal.

The data modifier may increase the data voltage when the determined luminance is lower than the target luminance and decrease the data voltage when the determined luminance is higher than the target luminance.

The driving current may increase as the data voltage increases, and the driving current may decrease as the data voltage decreases.

The first switching transistor and the driving transistor may include amorphous silicon thin film transistors, and may include nMOS thin film transistors.

The light emitting element may include a light emitting layer.

A display device is provided, which includes: a light emitting element; a driving transistor having a first terminal connect to a first voltage, a second terminal connected to the light emitting element, and a control terminal; a capacitor connected between the second terminal and the control terminal of the driving transistor; a sensing element generating photo current according to light emission of the light emitting element; a first switching element operating in response to a first scanning signal and connected between the control terminal of the driving transistor and a data voltage; a second switching element operating in response to a second scanning signal and connected between the control terminal of the driving transistor and a second voltage; a third switching element operating in response to a third scanning signal and connected between the first terminal of the driving transistor and the first voltage; a fourth switching element operating in response to the first scanning signal and outputting a sensing signal according to the photo current.

The display device may further include an inversion unit including first and second transistors and generating the third scanning signal, wherein the first transistor has a control terminal and an input terminal connected to a gate-on voltage and an input terminal connected to the third switching element, and the second transistor has a control terminal connected to the first scanning signal, an input terminal connected to the second scanning signal, and an output terminal connected to the third switching elements.

A method of driving a display device including a light emitting element, a driving transistor connected to the light emitting element, and a capacitor connected to the driving transistor and the light emitting element is provided, which includes: applying a data voltage to the driving transistor and the capacitor; supplying a driving current to the light emitting element through the driving transistor according to the data voltage to emit light; generating a sensing signal according to the light emission of the light emitting element; and modifying image signals by determining luminance corresponding to the sensing signal and comparing the determined luminance and a target luminance.

The display device may further include: applying a reverse bias voltage to the driving transistor; and selectively connecting the driving transistor to a driving voltage.

The selective connection may include: disconnecting the driving transistor from the driving voltage when the data voltage is applied to the driving transistor and the capacitor; and connecting the driving transistor to the driving voltage when the data voltage is not applied to the driving transistor and the capacitor.

The modification may include: increasing the data voltage when the determined luminance is lower than the target luminance; and decreasing the data voltage when the determined luminance is higher than the target luminance.

BRIEF DESCRIPTION OF THE DRAWINGS

The present invention will become more apparent by describing embodiments thereof in detail with reference to the accompanying drawing in which.

DETAILED DESCRIPTION OF THE PREFERRED EMBODIMENTS

Figure 1:
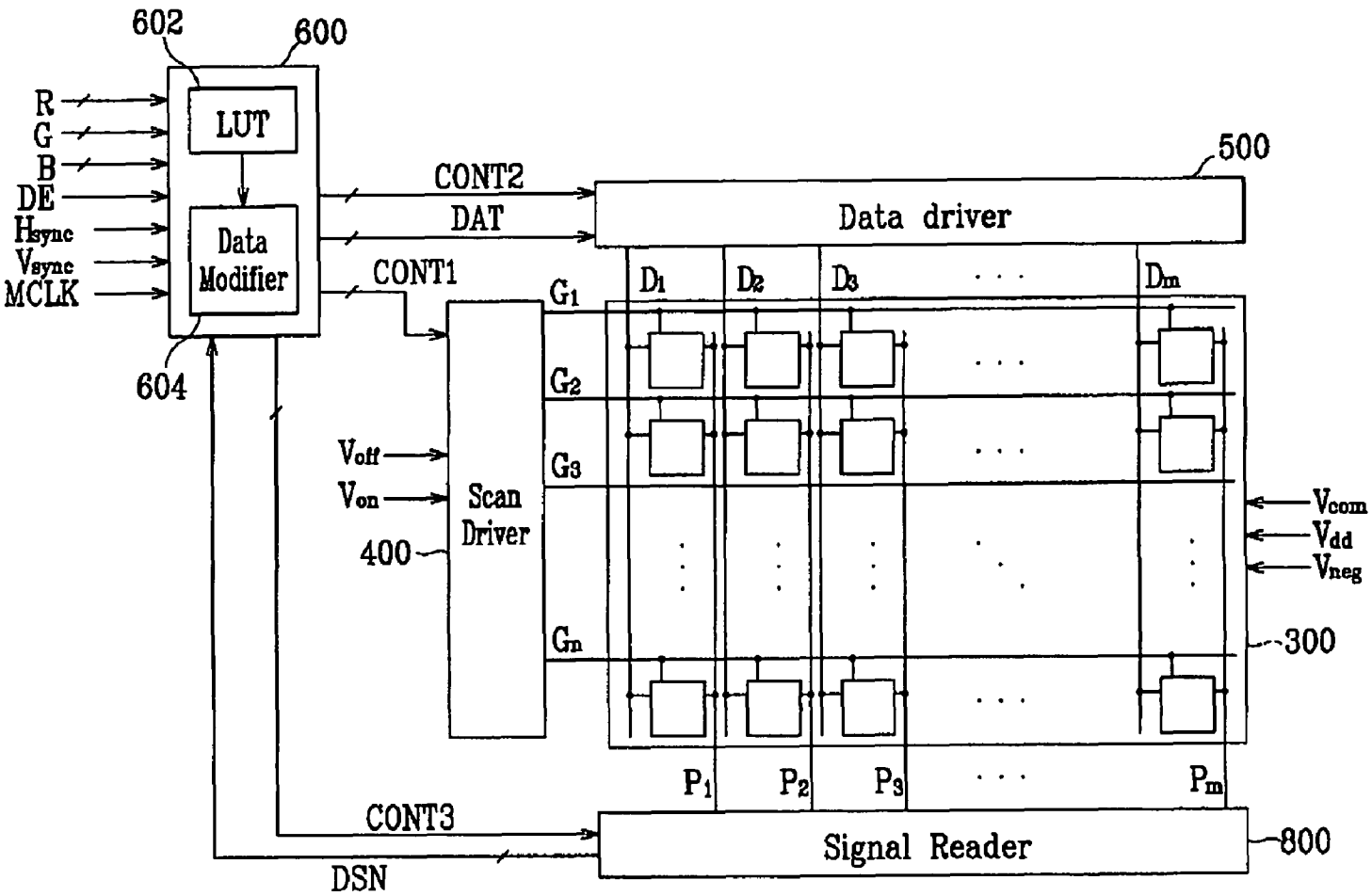
FIG. 1 is a block diagram of an OLED according to an embodiment of the present invention.

The present invention now will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, display devices and driving methods thereof according to embodiments of the present invention will be described with reference to the accompanying drawings.

Referring to FIGS. 1-4, an organic light emitting display (OLED) according to an embodiment of the present invention will be described in detail.

Figure 2:
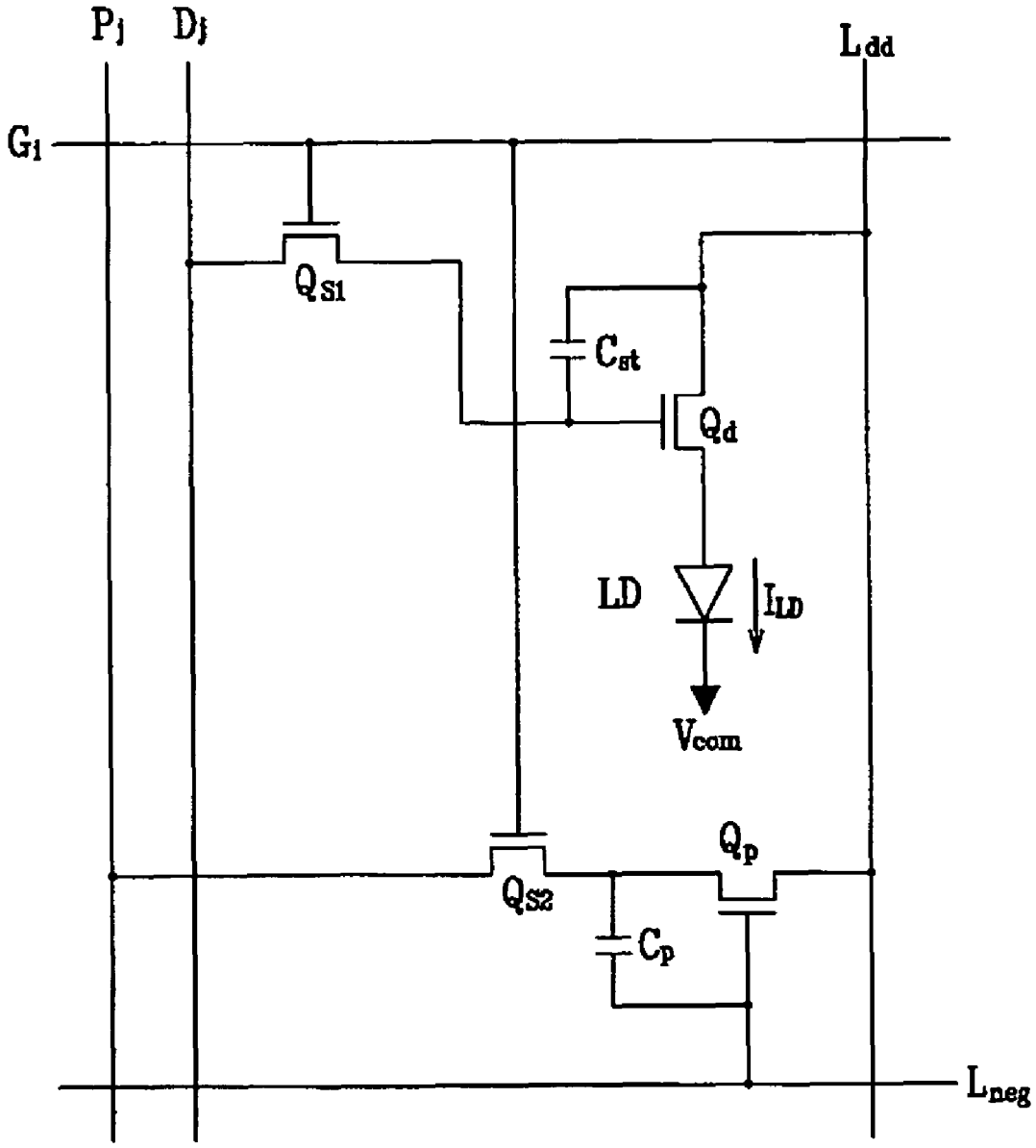
FIG. 2 is an equivalent circuit diagram of a pixel of an OLED according to an embodiment of the present invention.
Figure 3:
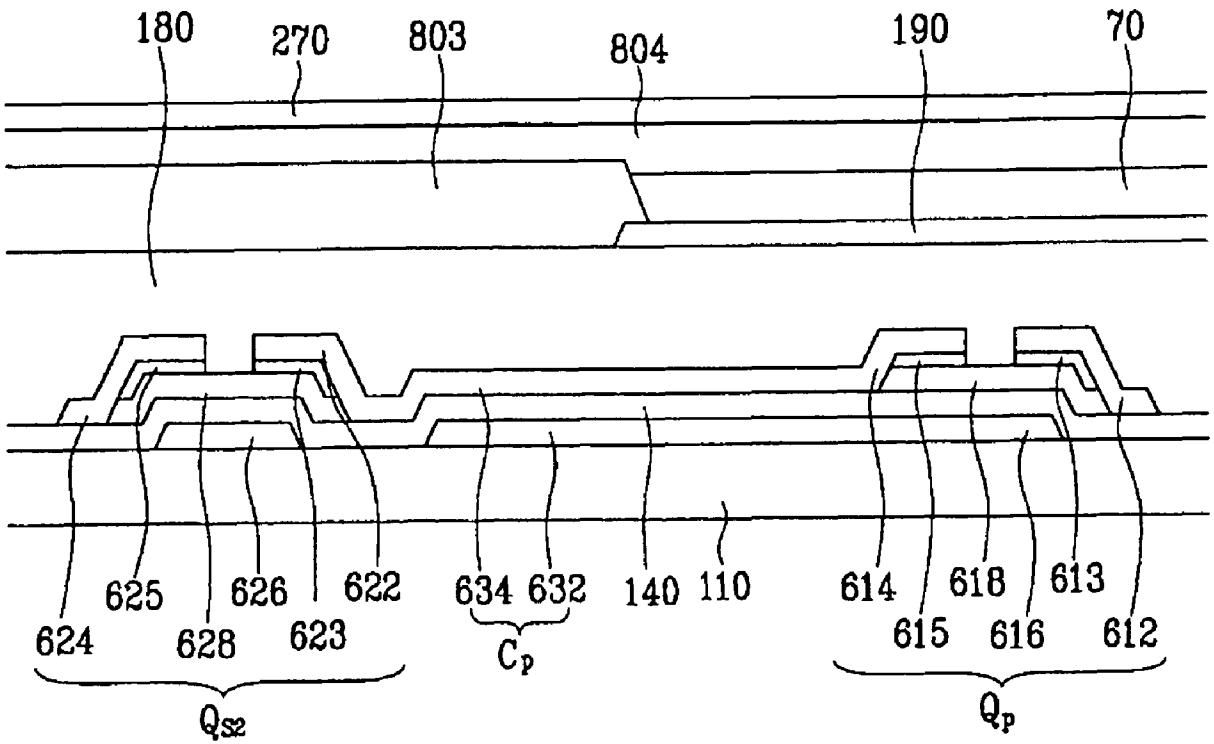
FIG. 3 is an exemplary sectional view of the OLED shown in FIG. 2.
Figure 4:
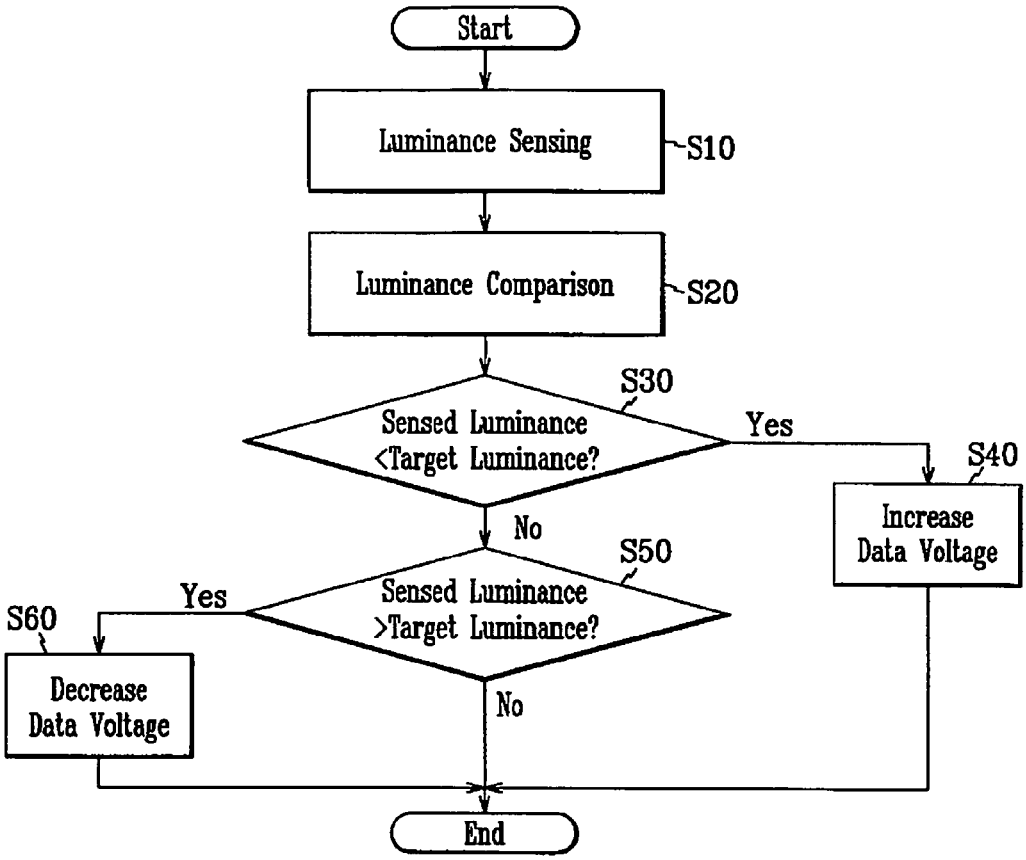
FIG. 4 is a flow chart illustrating a method of driving the OLED shown in FIGS. 1-3.

FIG. 1 is a block diagram of an OLED according to an embodiment of the present invention, FIG. 2 is an equivalent circuit diagram of a pixel of an OLED according to an embodiment of the present invention, FIG. 3 is an exemplary sectional view of the OLED shown in FIG. 2, and FIG. 4 is a flow chart illustrating a method of driving the OLED shown in FIGS. 1-3.

Referring to FIG. 1, an OLED according to an embodiment includes a display panel 300, a scan driver 400, a data driver 500, and a signal reader 800 that are connected to the display panel 300, and a signal controller 600 controlling the above elements.

Referring to FIG. 1, the display panel 300 includes a plurality of signal lines and a plurality of pixels connected thereto and arranged substantially in a matrix.

The signal lines include a plurality of scanning lines $G_1$-$G_n$ transmitting scanning signals, a plurality of data lines $D_1$-$D_m$ transmitting data signals, and a plurality of sensing lines $P_1$-$P_m$ transmitting sensing signals. The scanning lines $G_1$-$G_n$ extend substantially in a row direction and substantially parallel to each other, while the data lines $D_1$-$D_m$ and the sensing lines $P_1$-$P_m$ extend substantially in a column direction and substantially parallel to each other.

Referring to FIG. 2, the signal lines further include driving voltage lines $L_{dd}$ and reverse bias voltage lines $L_{neg}$.

Referring to FIG. 2, each pixel, for example, a pixel connected to a scanning line $G_i$ and a data line $D_j$ includes a display circuit including a driving transistor $Q_d$, a switching transistor Qs1, a storage capacitor $C_{st}$, and an organic light emitting element LD and a light sensing circuit including a sensor transistor $Q_p$ connected to the signal lines $L_{dd}$ and $L_{neg}$, a switching transistor $Q_{S2}$ connected to the signal lines $G_i$ and $P_j$, and a sensor capacitor $C_p$ connected to the transistors $Q_{S2}$ and $Q_p$.

The switching transistor Qs1 has a control terminal connected to the scanning line $G_i$, an input terminal connected to the data line $D_j$, and an output terminal connected to the driving transistor $Q_d$. The switching transistor $Q_{s1}$ transmits data signals from the data line $D_j$ to the driving transistor Qd in response to the scanning signals from the scanning line $G_i$.

The driving transistor $Q_d$ has a control terminal connected to the switching transistor $Q_{s1}$, an input terminal connected to the driving voltage line $L_{dd}$, and an output terminal connected to the light emitting element LD. The driving transistor $Q_d$ outputs an output current $I_{LD}$ having a magnitude depending on a voltage difference between the control terminal and the output terminal thereof.

The storage capacitor $C_{st}$ is connected between the control terminal and the output terminal of the driving transistor $Q_d$, and maintains the voltage difference between the control terminal and the output terminal of the driving transistor $Q_d$.

The light emitting element LD has a cathode connected to a common voltage $V_{com}$ and an anode connected to the output terminal of the driving transistor $Q_d$. The light emitting element LD emits light due to the voltage difference between the anode and the cathode and the intensity of light depends on the output current $I_{LD}$ of the driving transistor $Q_d$. In detail, when the driving transistor $Q_d$ turns on to apply a voltage to the anode, the voltage difference between the anode and the cathode causes for the anode to inject holes and for the cathode to inject electrons and the holes and the electrons undergo electron-hole pair recombination to emit light having an intensity depending on the output current $I_{LD}$ of the driving transistor $Q_d$.

The sensor transistor $Q_P$ has a control terminal connected to the reverse bias line $L_{neg}$, an input terminal connected to the driving voltage line $L_{dd}$, and an output terminal connected to the sensor capacitor $C_P$ and the switching transistor $Q_{S2}$. The sensor transistor $Q_P$ has a channel semiconductor that is disposed under the light emitting element LD and generates photocurrent according to the light emission of the light emitting element LD. The photocurrent flows to the sensor capacitor $C_P$ and the switching transistor $Q_{S2}$ due to the driving voltage $V_{dd}$ of the driving voltage line $L_{dd}$.

The sensor capacitor $C_P$ is connected between the control terminal and the output terminal of the sensor transistor $Q_P$ and stores the electrical charge output from the sensor transistor $Q_P$ to maintain a predetermined voltage. The sensor capacitor $C_P$ may be omitted if unnecessary.

The switching transistor $Q_{S2}$ has a control terminal connected to the gate line Gi, an input terminal connected to one $P_j$ of the sensing lines $P_1$-$P_m$, and an output terminal connected to the sensor transistor $Q_P$. The switching transistor $Q_{S2}$ outputs a sensing signal $V_P$ that may be a voltage stored in the sensor capacitor $C_P$ or the photocurrent from the sensor transistor $Q_P$ in response to the gate signal from the gate line $G_i$.

A structure of a pixel including a display unit and a light emitting unit shown in FIG. 2 will be described in detail with reference to FIG. 3.

A plurality of control electrodes 616 and 626 are formed on an insulating substrate 110. The control electrode 616 extends to form a first electrode 632.

An insulating layer 140 is formed on the control electrodes 616 and 626 and the first electrode 632.

A pair of semiconductors 618 and 628 are formed on the insulating layer 140, and a plurality of ohmic contacts 613, 615, 623 and 625 are formed on the semiconductors 618 and 628. The ohmic contacts 613 and 615 and the ohmic contacts 623 and 625 are disposed on the semiconductors 618 and 628 in pairs.

A pair of input electrodes 612 and 622 and a pair of output electrodes 614 and 624 are formed on the ohmic contacts 613, 615, 623 and 625 and the insulating layer 140. The output electrode 614 extends to form a second electrode 634, which in turn is connected to the input electrode 622.

The control electrode 616, the input electrode 612, and the output electrode 614 as well as the semiconductor 618 form a TFT serving as a sensor transistor $Q_P$. Likewise, the control electrode 626, the input electrode 622, and the output electrode 624 as well as the semiconductor 628 form another TFT serving as a switching transistor $Q_{S2}$. The first electrode 632 and the second electrode 634 overlap each other to form a sensor capacitor $C_P$.

A passivation layer 180 is formed on the input electrodes 612 and 622, the output electrodes 614 and 624, and the insulating layer 140.

A partition 803 is formed on the passivation layer 180 and it encloses the pixel electrode 190 and a periphery of the pixel electrode 190 to define a depression.

An organic light emitting member 70 is formed on the pixel electrode 190 and enclosed by the partition 803.

A buffer layer 804 is formed on the partition 803 and the organic light emitting member 70, and a common electrode 270 is formed on the buffer layer 804.

The pixel electrode 190, the organic light emitting member 70, and the common electrode 270 form a light emitting element LD. One of the pixel electrodes 190 and the common electrode 270 functions as an anode, while the other functions as a cathode.

Since the semiconductor 618 of the sensor transistor $Q_P$ is disposed under the organic light emitting member 70 as shown in FIG. 3, it receives light from the organic light emitting member 70. A light blocking member (not shown) may be formed on the semiconductor 628 of the switching transistor $Q_{S2}$.

The driving transistor $Q_d$, the sensor transistor $Q_P$, and the switching transistor $Q_{S1}$ and $Q_{S2}$ include amorphous silicon n channel nMOS (metal-oxide-semiconductor) transistors. However, they may include pMOS transistors that may have operations, voltages, and currents opposite to those of nMOS transistors.

Referring to FIG. 1 again, the scan driver 400 is connected to the scanning lines $G_1$-$G_n$ of the display panel 300 and synthesizes a gate-on voltage Von for turning on the switching transistors $Q_{S1}$ and $Q_{S2}$ and a gate-off voltage Voff for turning off the switching transistors $Q_{S1}$ and $Q_{S2}$ to generate scanning signals for application to the scanning lines $G_1$-$G_n$.

The data driver 500 is connected to the data lines $D_1$-$D_m$ of the display panel 300 and applies data signals, which are selected from the gray voltages supplied from the gray voltage generator 800, to the data lines $D_1$-$D_m$.

The signal reader 800 is connected to the sensing lines $P_1$-$P_m$ of the display panel 300 and receives the sensing signals $V_P$ from the sensing lines $P_1$-$P_m$. The signal reader 800 processes the sensing signals $V_P$ and supplies the processed sensing signals DSN to the signal controller 600.

The scan driver 400, the data driver 500, or the signal reader 800 may be implemented as integrated circuit (IC) chip mounted on the display panel 300 or on a flexible printed circuit (FPC) film in a tape carrier package (TCP) type, which are attached to the display panel 300. Alternately, they may be integrated into the display panel 300.

The signal controller 600 controls the scan driver 400, the data driver 500, and the signal reader 800. In addition, the signal controller 600 includes a lookup table 602 and a data modifier 604. The lookup table 602 stores luminance information corresponding to the sensing signal DSN, and the data modifier 604 modifies image signals based on the luminance information from the lookup table 602 and a target luminance.

Now, the operation of the above-described OLED will be described in detail.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating scan control signals CONT1, data control signals CONT2, and read control signals CONT3 and processing the image signals R, G and B suitable for the operation of the display panel 300 on the basis of the input control signals and the input image signals R, G and B. The signal controller 600 sends the scan control signals CONT1 to the scan driver 400, the processed image signals DAT and the data control signals CONT2 to the data driver 500, and the read control signals CONT3 to the signal reader 800.

The scan control signals CONT1 include a scanning start signal STV for instructing to start scanning and at least one clock signal for controlling the output time of the gate-on voltage Von. The scan control signals CONT1 may include a plurality of output enable signals for defining the duration of the gate-on voltage Von.

The data control signals CONT2 include a horizontal synchronization start signal STH for informing of start of data transmission for a group of pixels, a load signal LOAD for instructing to apply the data voltages to the data lines $D_1$-$D_m$, and a data clock signal HCLK.

Responsive to the data control signals CONT2 from the signal controller 600, the data driver 500 receives a packet of the image data for the group of pixels from the signal controller 600, converts the image data into analog data signals, and applies the data signals to the data lines $D_1$-$D_m$.

The scan driver 400 applies the gate-on voltage Von to the scanning line $G_1$-$G_n$ in response to the scan control signals CONT1 from the signal controller 600, thereby turning on the switching transistors Q connected thereto. The data signals applied to the data lines $D_1$-$D_m$ are supplied to the control terminals of the driving transistor Qd and the capacitors Cst through the activated switching transistors Q and the capacitors Cst store the data signals. The voltages of the capacitors Cst are maintained to keep the voltages of the control terminals of the driving transistors Qd after the switching transistors Qs1 are turned off.

The driving transistor $Q_d$ outputs an output current $I_{LD}$ having a magnitude depending on the data signals such that the light emitting element LD emits light having intensity depending on the output current $I_{LD}$, thereby displaying images.

By repeating this procedure by a unit of a horizontal period (also referred to as "1H" and equal to one period of the horizontal synchronization signal Hsync and the data enable signal DE, all scanning lines $G_1$-$G_n$ are sequentially supplied with the gate-on voltage Von during a frame (or a vertical period), thereby applying the data voltages to all pixels.

In the meantime, the signal reader 800 reads the sensing signals $V_P$ applied to the sensing lines $P_1$-$P_m$ through the activated switching transistor $Q_{S2}$ in response to the read control signal CONT3 of the signal controller 600. The signal reader 800 amplifies and filters the read sensing signals $V_P$ and converts them into digital sensing signals DSN to send them to the signal controller 600.

The signal controller 600 modifies image signals based on the sensing signals DSN, which will be described in detail with reference to FIG. 4.

First, the data modifier 604 detects the luminance of the light emission of the light emitting element LD (S10). In detail, the data modifier 604 reads luminance information corresponding to the sensing signals DSN from the lookup table 602.

Thereafter, the sensed luminance and a target luminance corresponding to the image signal for each pixel are compared (S20).

When the sensed luminance is lower than the target luminance (S30), the image signal is modified so that the data signal may be increased (540). Accordingly, the driving transistor $Q_d$ increases its output current $I_{LD}$ to increase the light intensity from the light emitting element LD.

When the sensed luminance is higher than the target luminance (S50), the image signal is modified so that the data signal may be decreased (S60). Accordingly, the driving transistor $Q_d$ decreases its output current $I_{LD}$ to decrease the light intensity from the light emitting element LD.

The image signal modification may be performed every frame or every two or more frames. In addition, some pixels may be provided with the light sensing units, while other pixels may be provided with no light sensing unit, and the image signal modification may be performed based on the average difference between the sensed luminance and the target luminance.

The control terminals of the switching transistors $Q_{S2}$ may be connected to a separately provided signal lines that may transmit signals from a separately provided driver.

The modification of the image signals based on the sensed luminance maintains uniform luminance regardless of the variation or change of the characteristics of the driving transistor $Q_d$ and the light emitting element LD.

Now, an OLED according to another embodiment of the present invention will be described in detail with reference to FIGS. 5-9. The description of the OLED according to this embodiment will be focused on the difference from the OLED shown in FIGS. 1-4.

Figure 5:
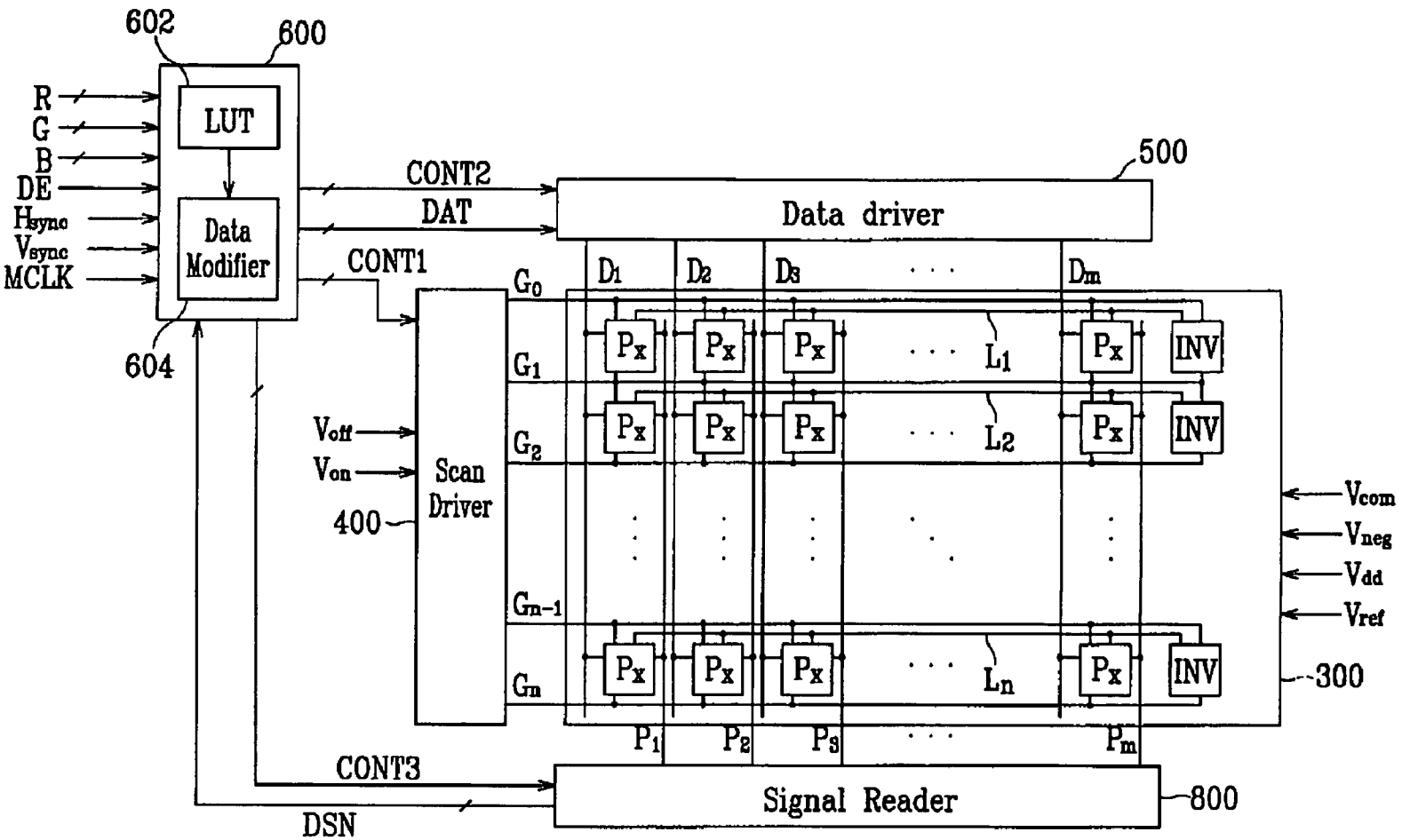
FIG. 5 is a block diagram of an OLED according to another embodiment of the present invention.
Figure 6:
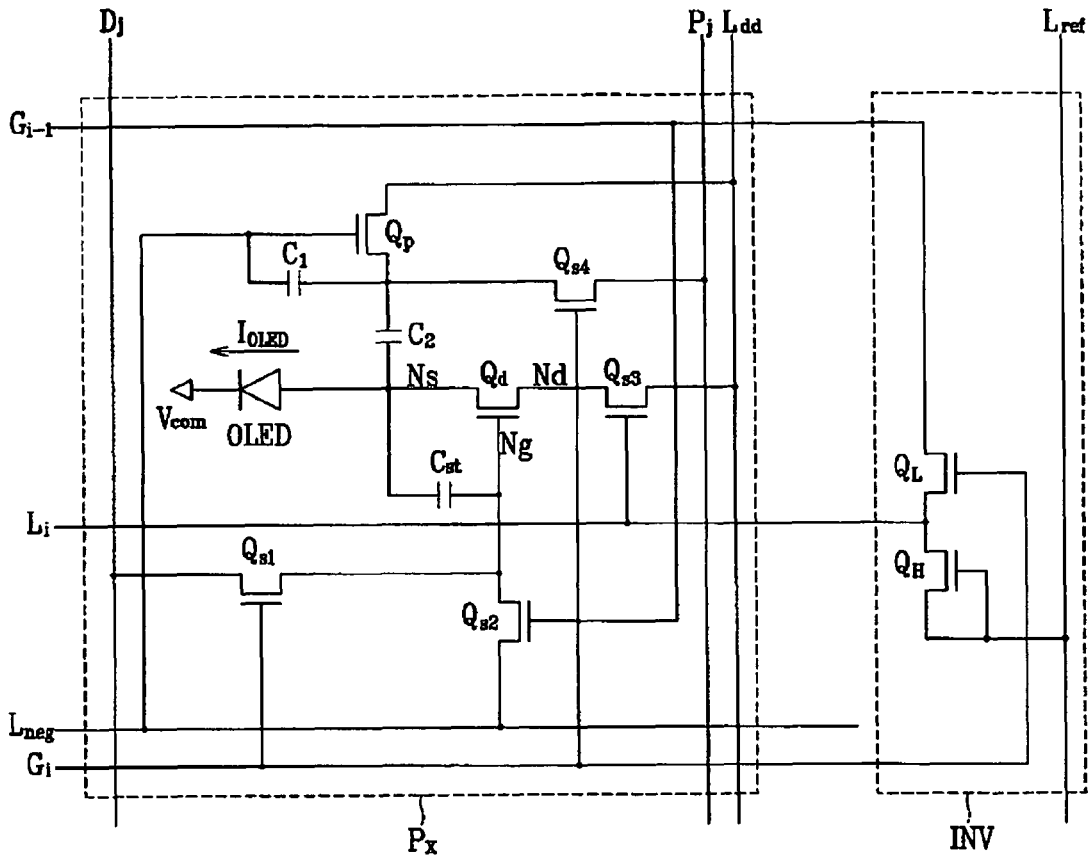
FIG. 6 is an exemplary equivalent circuit diagram of a pixel of the OLED shown in FIG. 5.
Figure 7:
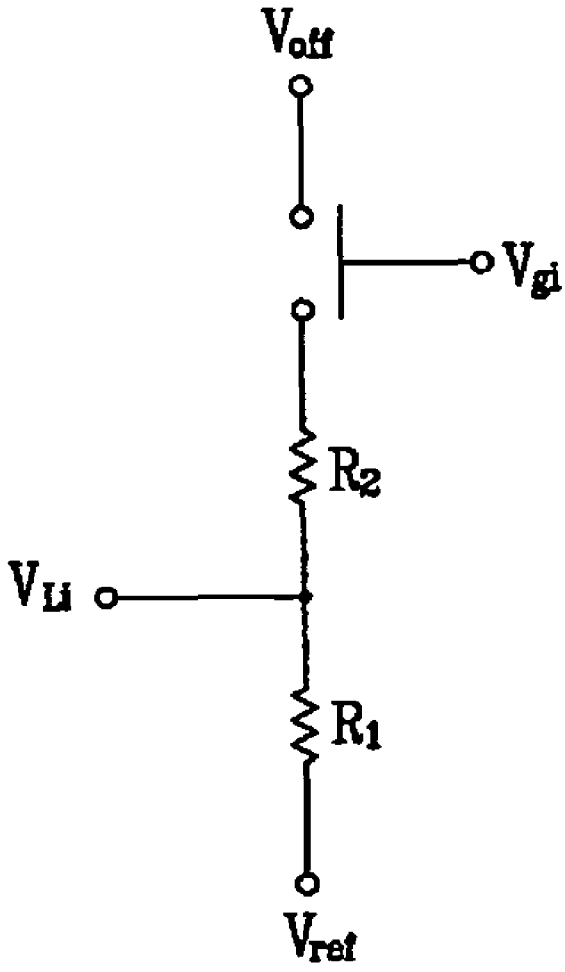
FIG. 7 is an exemplary equivalent circuit diagram of an inversion unit of the OLED shown in FIG. 5.
Figure 8:
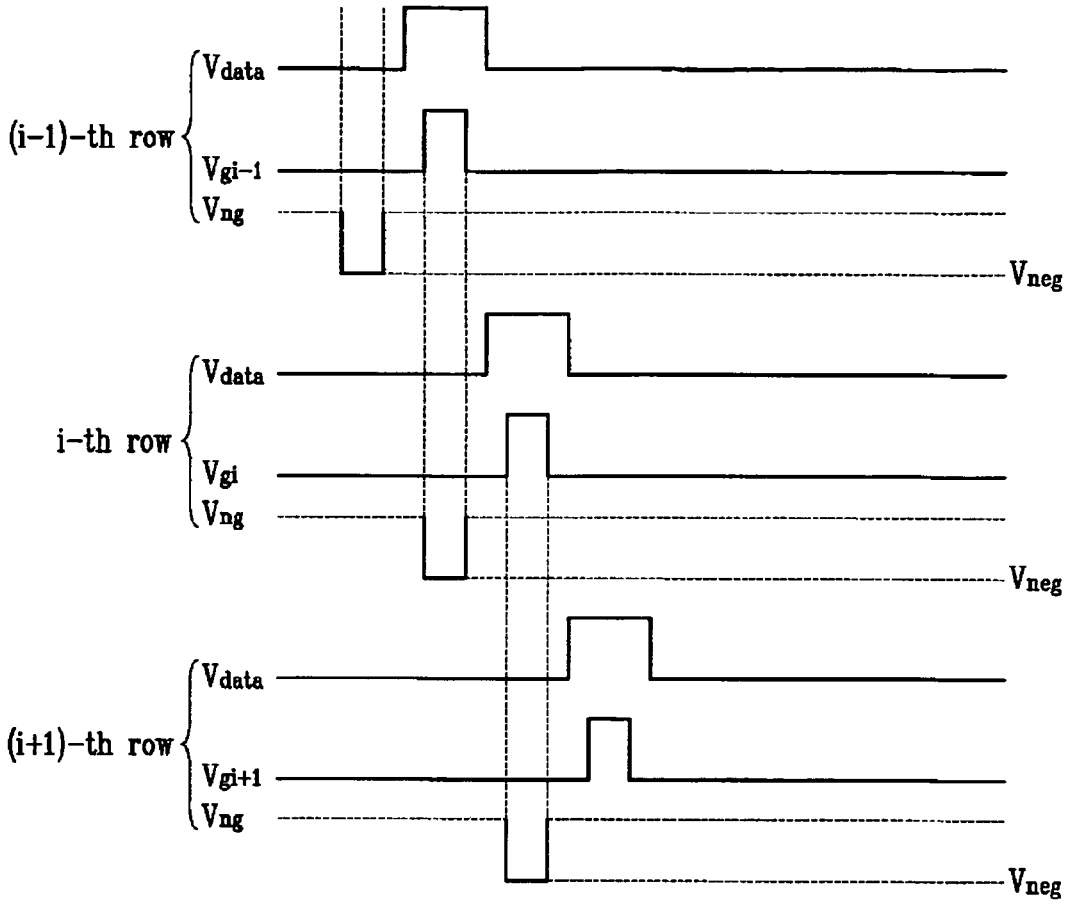
FIG. 8 is an exemplary timing diagram of the OLED shown in FIG. 5.
Figure 9:
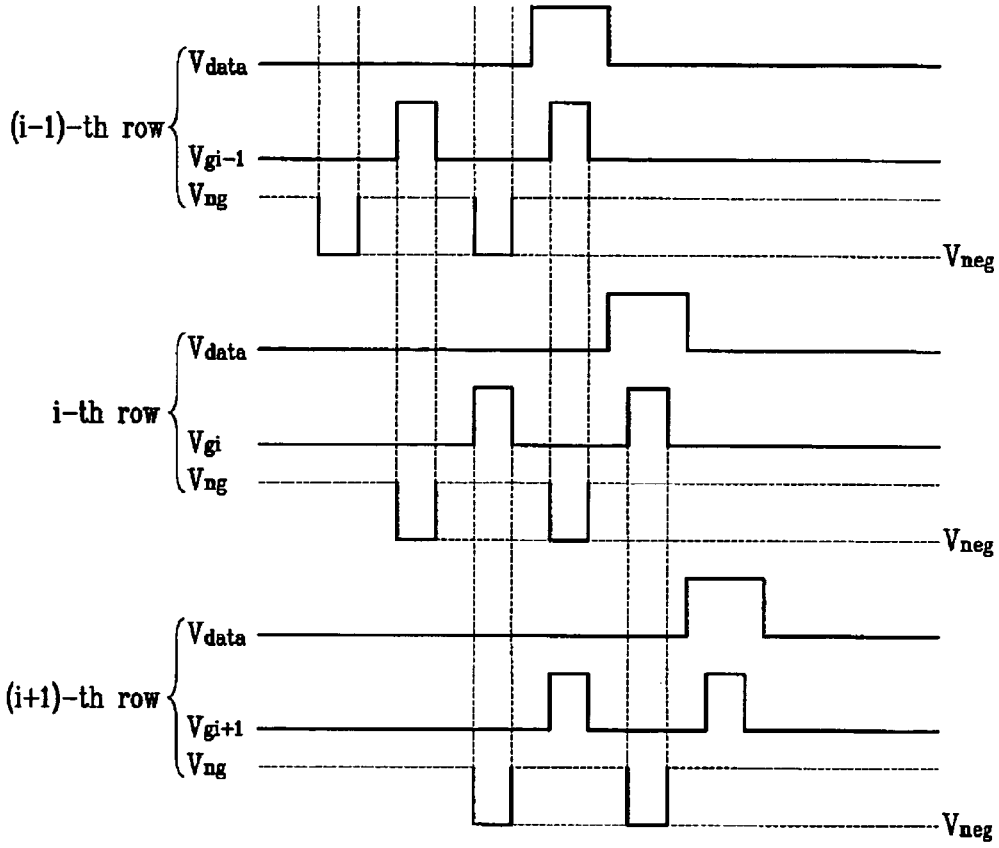
FIG. 9 is another exemplary timing diagram of the OLED shown in FIG. 5.

FIG. 5 is a block diagram of an OLED according to another embodiment of the present invention, FIG. 6 is an exemplary equivalent circuit diagram of a pixel of the OLED shown in FIG. 5, FIG. 7 is an exemplary equivalent circuit diagram of an inversion unit of the OLED shown in FIG. 5, FIG. 8 is an exemplary timing diagram of the LCD shown in FIG. 5, and FIG. 9 is another exemplary timing diagram of the LCD shown in FIG. 5.

Referring to FIG. 5, an OLED according to this embodiment includes a display panel 300, a scan driver 400, a data driver 500, and a signal reader 800 that are connected to the display panel 300, and a signal controller 600 controlling the above elements.

Referring to FIG. 5, the display panel 300 includes a plurality of signal lines and a plurality of pixels Px and a plurality of inversion units INV connected thereto. The pixels Px are arranged substantially in a matrix and one inversion unit INV is provided at every row.

The signal lines include a plurality of scanning lines $G_0$-$G_n$ transmitting scanning signals, a plurality of inversion signal lines $L_1$-$L_n$ transmitting inversion signals, a plurality of data lines $D_1$-$D_m$ transmitting data signals, and a plurality of sensing lines $P_1$-$P_m$ transmitting sensing signals. The scanning lines $G_0$-$G_n$ and the inversion signal lines $L_1$-$L_n$ extend substantially in a row direction and substantially parallel to each other, while the data lines $D_1$-$D_m$ and the sensing lines $P_1$-$P_m$ extend substantially in a column direction and substantially parallel to each other.

Referring to FIG. 6, the signal lines further include driving voltage lines $L_{dd}$, a reverse bias voltage line $L_{neg}$, and a reference voltage line $L_{ref}$ transmitting a reference voltage $V_{ref}$ to the inversion units INV.

Referring to FIG. 2, each pixel, for example, a pixel connected to a scanning line $G_i$ and a data line $D_j$ includes a display circuit including a driving transistor $Q_d$, three switching transistors $Q_{S1}$, $Q_{S2}$ and $Q_{S3}$, a storage capacitor $C_{st}$, and an organic light emitting element LD and a light sensing circuit including a sensor transistor $Q_p$ connected to the signal lines $L_{dd}$ and $L_{neg}$, a switching transistor $Q_{S4}$ connected to the signal lines $G_i$ and $P_j$, and a pair of sensor capacitors $C_1$ and $C_2$ connected to the transistors $Q_{S4}$ and $Q_P$.

The switching transistor $Q_{s1}$ has a control terminal connected to the scanning lines $G_i$, an input terminal connected to one of the data lines $D_j$, and an output terminal connected to the driving transistor $Q_d$. The switching transistor $Q_{s1}$ transmits data signals from the data line $D_j$ to the driving transistor $Q_d$ in response to the scanning signals from the scanning line $G_i$.

The switching transistor $Q_{S2}$ has a control terminal connected to a previous scanning line $G_{i-1}$, an input terminal connected to the reverse bias voltage line $L_{neg}$, and an output terminal connected to the driving transistor $Q_d$. The switching transistor $Q_{s2}$ transmits the reverse bias voltage $V_{neg}$ from the reverse bias voltage line $L_{neg}$ to the driving transistor $Q_d$ in response to the scanning signals from the scanning line $G_i$.

The switching transistor $Q_{s3}$ has a control terminal connected to the scanning line $G_i$, an input terminal connected to the driving voltage line $L_{dd}$, and an output terminal connected to the driving transistor $Q_d$. The switching transistor $Q_{s3}$ connects the driving transistor $Q_d$ to the driving voltage line $L_{dd}$ in response to inversion signals from the inversion signal line $L_i$.

The driving transistor $Q_d$ has a control terminal Ng connected to the switching transistors $Q_{s1}$ and $Q_{s2}$, an input terminal Nd connected to the switching transistor $Q_{S3}$, and an output terminal Ns connected to the light emitting element LD.

The driving transistor $Q_d$ outputs an output current $I_{LD}$ having a magnitude depending on a voltage difference $V_{gs}$ between the control terminal Ng and the output terminal Ns thereof.

The sensor transistor $Q_P$ has a control terminal connected to the reverse bias line $L_{neg}$, an input terminal connected to the driving voltage line $L_{dd}$, and an output terminal connected to the sensor capacitors $C_1$ and $C_2$ and the switching transistor $Q_{S4}$. The sensor transistor $Q_P$ has a channel semiconductor that is disposed under the light emitting element LD and generates photocurrent according to the light emission of the light emitting element LD. The photocurrent flows to the sensor capacitors $C_1$ and $C_2$ and the switching transistor $Q_{S4}$ due to the driving voltage $V_{dd}$ of the driving voltage line $L_{dd}$.

The sensor capacitor $C_1$ is connected between the control terminal and the output terminal of the sensor transistor $Q_P$ and the sensor capacitor $C_2$ is connected between the sensor transistor $Q_P$ and the driving transistor $Q_d$. The sensor transistors $C_1$ and $C_2$ store the electrical charge output from the sensor transistor $Q_P$ to maintain a predetermined voltage. The sensor capacitors $C_1$ and $C_2$ may be omitted if unnecessary.

The switching transistor $Q_{S4}$ has a control terminal connected to the gate line $G_i$, an input terminal connected to one $P_j$ of the sensing lines $P_1$-$P_m$, and an output terminal connected to the sensor transistor $Q_P$. The switching transistor $Q_{S4}$ outputs a sensing signal $V_P$ that may be a voltage stored in the sensor capacitors $C_1$ and $C_2$ or the photocurrent from the sensor transistor $Q_P$ in response to the gate signal from the gate line $G_i$. The control terminal of the switching transistor $Q_{S4}$ may be connected to a separately provided signal line that may transmit a separate scanning line.

The driving transistor $Q_d$, the sensor transistor $Q_P$, and the switching transistor $Q_{S1}$, $Q_{S2}$, $Q_{S3}$ and $Q_{S4}$ may include amorphous silicon n channel or p channel nMOS or pMOS transistors.

Each of the inversion unit INV includes a pair of transistors $Q_H$ and $Q_L$.

The transistor $Q_H$ has an input terminal and a control terminal commonly connected to the reference voltage $V_{ref}$, and an output terminal connected to the inversion signal lines $L_i$. The transistor $Q_L$ has an input terminal connected to the previous scanning line $G_{i-1}$, a control terminal connected to the scanning lines $G_i$, and an output terminal connected to the inversion signal line $L_i$.

The inversion unit INV outputs the inversion signal $V_{Li}$ having a waveform reversed to that of the scanning signal $V_{gi}$. In detail, when the scanning line $G_i$ is supplied with the gate-on voltage $V_{on}$, the inversion signal $V_{Li}$ has a low level for turning off the switching transistor $Q_{S3}$, and on the contrary, when the scanning line $G_i$ is supplied with a gate-off voltage $V_{off}$, the inversion signal $V_{Li}$ has a high level for turning on the switching transistor $Q_{S3}$.

Referring to FIG. 8 again, the scan driver 400 is connected to the scanning lines $G_0$-$G_n$ of the display panel 300 and synthesizes a gate-on voltage Von for turning on the switching transistors $Q_{S1}$, $Q_{S2}$, and $Q_{S4}$ and a gate-off voltage Voff for turning off the switching transistors $Q_{S1}$, $Q_{S2}$, and $Q_{S4}$ to generate scanning signals for application to the scanning lines $G_0$-$G_n$.

The data driver 500, the signal reader 800, and the signal controller 600 have similar configurations as those shown in FIGS. 1-4 and the detailed descriptions thereof will be omitted.

Now, the operations of the pixels Px and the inversion units INV shown in FIGS. 5 and 6 will be described in detail with reference to FIGS. 7-9.

Referring to FIG. 8, since the switching transistor $Q_{S2}$ of a pixel row, for example, the i-th pixel row is connected to the previous scanning lines $G_{i-1}$, it is turned on by the scanning signal $V_{gi-1}$ for the (i−1)-th row to apply the reverse bias voltage $V_{neg}$ to the control terminal Ng of the driving transistor $Q_d$. The reverse bias voltage $V_{neg}$ is a negative voltage such as the gate-off voltage $V_{off}$. Thereafter, the switching transistor $Q_{S1}$ is turned on by the scanning signal $V_{gi}$ for the i-th row to display an image.

It is noted that the scanning line $G_0$ and the scanning signal $V_{g0}$ is used for applying the reverse bias voltage $V_{neg}$ to the first pixel row.

The application of the reverse bias voltage $V_{neg}$ before the application of the data voltage $V_{data}$ improves the stability of the driving transistor $Q_d$. In addition, the use of the previous scanning line and the previous scanning signal increases the aperture ratio and requires no design change or no additional driver other than the scan driver 400.

Moreover, referring to FIG. 8, the scan driver 400 applies the gate-on voltage $V_{on}$ twice to each scanning line $G_0$-$G_n$ every "1H." Accordingly, the driving transistor $Q_d$ is supplied with the reverse bias voltage $V_{neg}$ for "2H" to further improve the stability of the driving transistor $Q_d$.

At this time, the data voltage for the (i−2)-th pixel row that may be applied to the i-th row serves as precharging voltage.

The twice application of the gate-on voltage $V_{on}$ may be continuously performed without stop unlike FIG. 8.

The number of the application of the gate-on voltage $V_{on}$ may be more than two.

In the meantime, the inversion units INV is represented as the equivalent circuit shown in FIG. 7, where the transistor $Q_H$ is represented as a resistor $R_1$ and the transistor $Q_L$ is a switching transistor that may be converted into a resistor $R_2$ when it is turned on.

During the application of the gate-on voltage $V_{on}$ to the scanning line $G_i$, the transistor $Q_L$ turns on and the transistor $Q_L$ is supplied with the gate-off voltage $V_{off}$ through the scanning lines $G_{i-1}$. At this time, the inversion signal $V_{Li}$ is given by Equation (1) and has a voltage level for turning off the switching transistor $Q_{S3}$. It can be obtained by adjusting the channel width and length of the transistors $Q_L$ and $Q_H$ and thus the resistances $R_1$ and $R_2$.

$$V_{Li} = V_{ref} - R_1 \frac{V_{ref} - V_{off}}{R_1 + R_2} \quad (1)$$

Therefore, the switching transistor $Q_{S3}$ is turned off to disconnect the driving transistor $Q_d$ from the driving voltage $V_{dd}$ and the data voltage $V_{data}$ is written into the driving transistor $Q_d$ and the capacitor $C_{st}$. At this time, the output terminal voltage of the driving transistor $Q_d$ decreases up to the threshold voltage Vth of the light emitting element LD and thus the control voltage $V_{gs}$ of the driving transistor Qd, which determines the output current $I_{LD}$ of the driving transistor $Q_d$, is determined by the data voltage $V_{data}$, i.e., $V_{gs}=V_{data}-V_{th}$.

Next, during the application of the gate-off voltage $V_{off}$ to the scanning lines $G_i$, the transistor $Q_L$ is turned off and the inversion units INV outputs the reference voltage $V_{ref}$ as the inversion signal $V_{Li}$. The reference voltage $V_{ref}$ is capable of turning on the switching transistor $Q_{S3}$ and it may be equal to the gate-on voltage $V_{on}$. Therefore, the driving voltage $V_{dd}$ is transmitted to the driving transistor $Q_d$ and the driving transistor $Q_d$ outputs the output current $I_{LD}$ to the light emitting element LD depending on the control voltage $V_{gs}$ to make the light emitting element LD emit.

The disconnection of the driving transistor $Q_d$ from the driving voltage $V_{dd}$ during the writing of the data voltage $V_{data}$ into the driving transistor $Q_d$ may prevent the decrease of the dynamic range of the control voltage $V_{gs}$, thereby effectively using the data voltage $V_{data}$.

The OLED according to this embodiment can also maintain uniform luminance regardless of the variation or change of the characteristics of the driving transistor $Q_d$ and the light emitting element LD.

Now, a structure of an OLED according to an embodiment of the present invention will be described in detail with reference to FIGS. 10-14.

Figure 10:
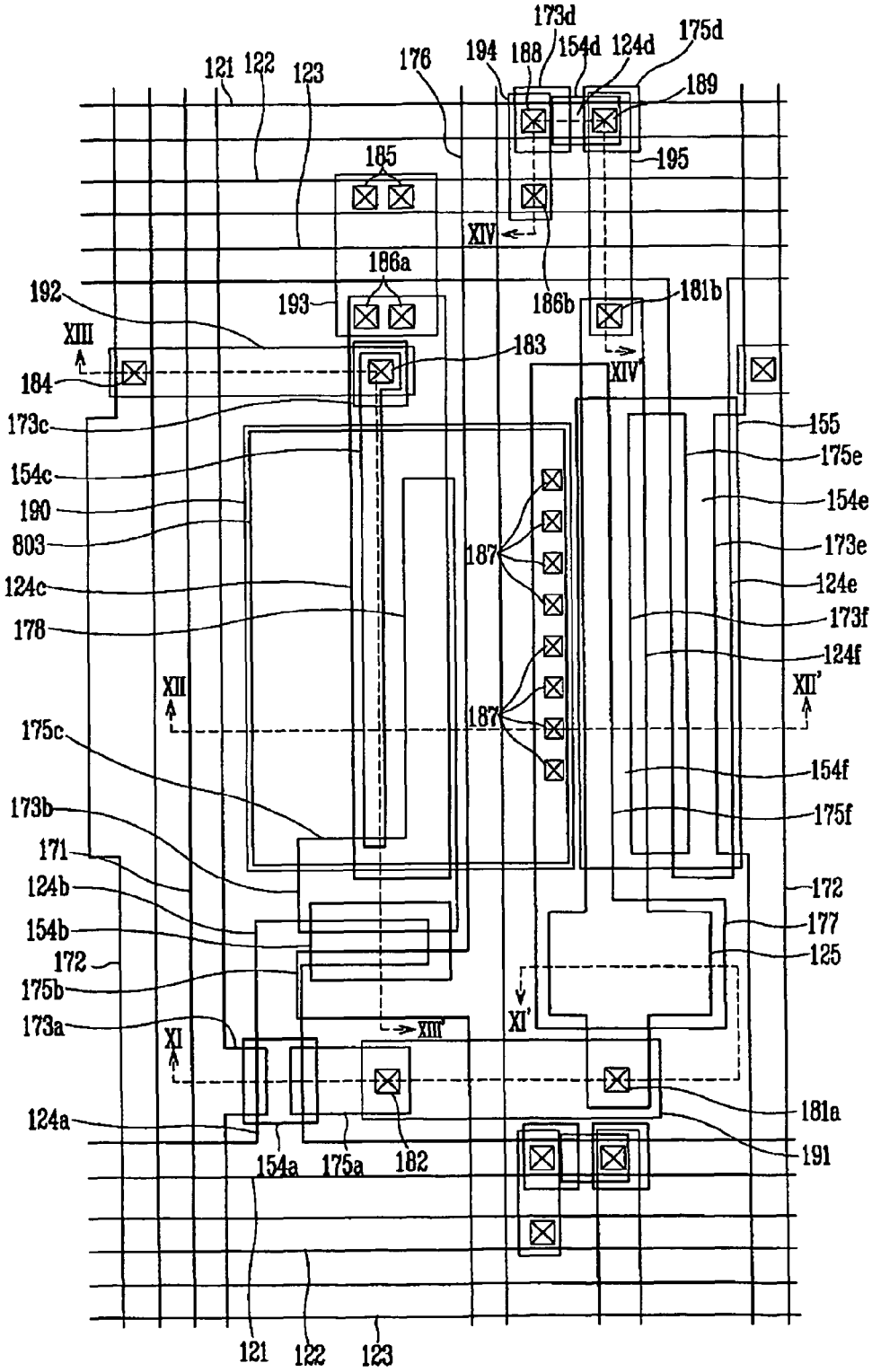
FIG. 10 is an exemplary layout view of the OLED shown in FIGS. 5-9.
Figure 11:
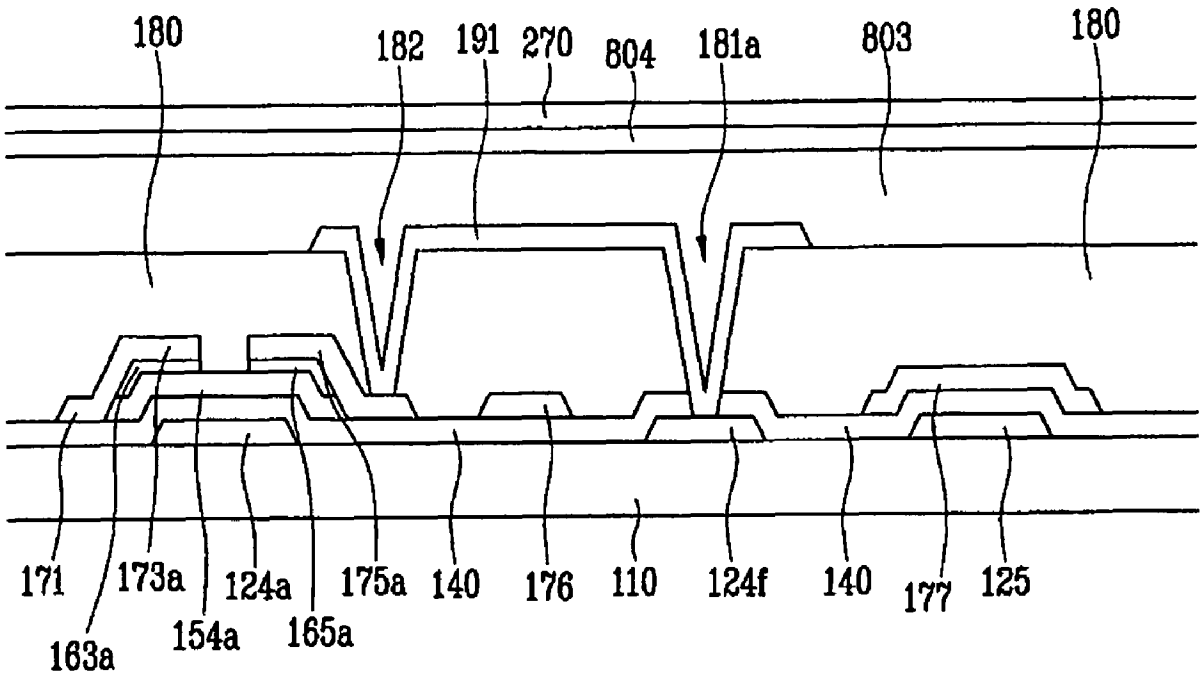
FIGS. 11-14 are sectional views of the OLED shown in FIG. 10 taken along the lines XI-XI', XII-XII', XIII-XIII', and XIV-XIV'.

FIG. 10 is an exemplary layout view of the OLED shown in FIGS. 5-9 and FIGS. 11-14 are sectional views of the OLED shown in FIG. 10 taken along the lines XI-XI', XII-XII', XIII-XIII', and XIV-XIV'.

Referring to FIGS. 10-14, a plurality of scanning lines 121, a plurality of reverse bias voltage lines 122, a plurality of inversion signal lines 123, and a plurality of the control terminal electrodes 124*c* and 124*f* are formed on an insulating substrate 110.

The scanning lines 121, the reverse bias voltage lines 122, and the inversion signal lines 123 extend substantially in a transverse direction and they are separated from one another. The scanning lines 121, the reverse bias voltage lines 122, and the inversion signal lines 123 transmit scanning signals, reverse bias voltage $V_{neg}$, inversion signals, respectively.

Each of the scanning lines 121 includes a plurality of control terminal electrodes 124*d*, a plurality of control terminal electrodes 124*a* projecting upward, and a plurality of control terminal electrodes 124*b* extending from the control terminal electrodes 124*a*.

Each of the inversion signal lines 123 includes a plurality of control terminal electrodes 124*e* projecting downward.

The control terminal electrodes 124*c* and 124*f* are separated from the scanning lines 121 and the inversion signal lines 123 and extend in a longitudinal direction. Each of the control terminal electrodes 124*f* includes an expansion forming a storage electrode 125.

The scanning lines 121, the reverse bias voltage lines 122, the inversion signal lines 123, and the control terminal electrodes 124*c* and 124*f* are referred to as a gate wire hereinafter.

The gate wire 121, 122, 123, 124*c* and 124*f* are preferably made of Al containing metal such as Al and Al alloy, Ag containing metal such as Ag and Ag alloy, Cu containing metal such as Cu and Cu alloy, Mo containing metal such as Mo and Mo alloy, Cr, Ti or Ta. The gate wire 121, 122, 123, 124*c* and 124*f* may have a multi-layered structure including two films having different physical characteristics. One of the two films is preferably made of low resistivity metal including Al containing metal, Ag containing metal, and Cu containing metal for reducing signal delay or voltage drop in the gate wire 121, 122, 123, 124*c* and 124*f*. The other film is preferably made of material such as Mo containing metal, Cr, Ta or Ti, which has good physical, chemical, and electrical contact characteristics with other materials such as indium tin oxide (ITO) or indium zinc oxide (IZO). Good examples of the combination of the two films are a lower Cr film and an upper Al—Nd alloy film and a lower Al film and an upper Mo film.

The gate wire 121, 122, 123, 124*c* and 124*f* may include three or more conductive films.

In addition, the lateral sides of the gate wire 121, 122, 123, 124*c* and 124*f* are inclined relative to a surface of the substrate, and the inclination angle thereof ranges about 30-80 degrees.

A gate insulating layer 140 preferably made of silicon nitride (SiNx) is formed on the gate wire 121, 122, 123, 124*c* and 124*f*.

A plurality of semiconductors 154*a*, 154*b*, 154*c*, 154*d* and 155 preferably made of hydrogenated amorphous silicon (abbreviated to "a-Si") or polysilicon are formed on the gate insulating layer 140. Each of the semiconductors 155 includes two portions 154*e* and 154*f* and extends in the longitudinal direction along with the semiconductors 154*c*. The semiconductors 154*a*, 154*b*, 154*c*, 154*d*, 154*e* are 154*f* are disposed on the control terminal electrodes 124*a*, 124*b*, 124*c*, 124*d*, 124*e* and 124*f*.

A plurality of ohmic contacts 163*a*, 163*b*, 163*c*, 163*d*, 163*e*, 163*f*, 165*a*, 165*b*, 165*c*, 165*d*, 165*e* and 165*f* 165 preferably made of silicide or n+ hydrogenated a-Si heavily doped with n type impurity such as phosphorous are formed on the semiconductors 154*a*, 154*b*, 154*c*, 154*d*, 154*e* and 154*f*. The ohmic contacts 163*a*, 163*b*, 163*c*, 163*d*, 163*e* and 163*f* and the ohmic contacts 165*a*, 165*b*, 165*c*, 165*d*, 165*e* and 165*f* are disposed on the semiconductors 154*a*, 154*b*, 154*c*, 154*d*, 154*e* and 154*f* in pairs.

The lateral sides of the semiconductors 154*a*, 154*b*, 154*c*, 154*d*, 154*e* and 154*f* and the ohmic contacts 163*a*, 163*b*, 163*c*, 163*d*, 163*e*, 163*f*, 165*a*, 165*b*, 165*c*, 165*d*, and 165*f* are inclined relative to a surface of the substrate, and the inclination angles thereof are preferably in a range between about 30-80 degrees.

A plurality of data lines 171, a plurality of driving voltage line 172, a plurality of sensing lines 176, a plurality of input electrodes 173*b*, 173*c*, 173*d* and 173*f*, and a plurality of output electrode 175*a*, 175*c*, 175*d*, 175*e* and 175*f* are formed on the ohmic contacts 163*a*, 163*b*, 163*c*, 163*d*, 163*e*, 163*f*, 165*a*, 165*b*, 165*c*, 165*d*, 165*e* and 165 *f* and the gate insulating layer 140.

The data lines 171, the driving voltage line 172, and the sensing lines 176 extend substantially in the longitudinal direction and cross the scanning lines 121, the reverse bias voltage lines 122, and the inversion signal lines 123. The data lines 171, the driving voltage line 172, and the sensing lines 176 transmit the data voltages $V_{data}$, the driving voltage $V_{dd}$, and the sensing signals $V_p$, respectively.

The output terminal electrodes 175*c* and the input terminal electrodes 173*b* are connected to each other and include expansions 178 extending from an end thereof in the longitudinal direction and overlapping the control terminal electrodes 124*c*. The sensor capacitors $C_1$ are formed by the overlap of the control terminal electrodes 124*c* and the expansions 178. The output terminal electrodes 175*e* and the input terminal electrodes 173*f* are connected to each other and extend in the longitudinal direction. The output terminal electrodes 175*f* also extend in the longitudinal direction and include expansions 177 overlapping the storage electrodes 125. The storage capacitors $C_{st}$ are formed by the overlap of the storage electrodes 125 and the expansions 177.

Each of the data lines 171 includes a plurality of the input terminal electrodes 173*a* projecting toward the output terminal electrodes 175*a*. A pair of an input terminal electrode 173*a* and an output terminal electrode 175*a* are separated from each other and disposed opposite each other with respect to a control terminal electrode 124*a*. A control terminal electrode 124*a*, an input terminal electrodes 173*a*, and an output terminal electrode 175*a* along with a semiconductor 154*a* form a switching transistor $Q_{S1}$ having a channel formed in the semiconductor 154*a* disposed between the input terminal electrode 173*a* and the output terminal electrode 175*a*.

Each of the sensing lines 176 includes a plurality of the output terminal electrodes 175*b* projecting opposite the input terminal electrodes 173*b*. A pair of an input terminal electrode 173*b* and an output terminal electrode 175*b* are separated from each other and disposed opposite each other with respect to a control terminal electrode 124*b*. A control terminal electrode 124*b*, an input terminal electrode 173*b*, and an output terminal electrode 175*b* along with a semiconductor 154*b* form a switching transistor $Q_{S4}$ having a channel in the semiconductor 154*b* disposed between the input terminal electrode 173*b* and the output terminal electrode 175*b*.

A pair of an input terminal electrode 173*c* and an output terminal electrode 175*c* are separated from each other and disposed opposite each other with respect to a control terminal electrode 124*c*. A control terminal electrode 124*c*, an input terminal electrode 173*c*, and an output terminal electrode 175*c* along with a semiconductor 154*c* form a sensor transistor $Q_P$ having a channel in the semiconductor 154*c* disposed between the input terminal electrode 173*c* and the output terminal electrode 175*c*.

A pair of an input terminal electrode 173*d* and the output terminal electrode 175*d* are separated from each other and disposed opposite each other with respect to a control terminal electrode 124*d*. A control terminal electrode 124*d*, an input terminal electrode 173*d*, and an output terminal electrode 175*d* along with a semiconductor 154*d* form a switching transistor $Q_{S2}$ having a channel in the semiconductor 154*d* disposed between the input terminal electrode 173*d* and the output terminal electrode 175*d*.

Each of the driving voltage lines 172 includes a plurality of the input terminal electrodes 173*e* projecting toward the output terminal electrodes 175*e*. A pair of an input terminal electrode 173*e* and an input terminal electrode 175*e* are separated from each other and disposed opposite each other with respect to a control terminal electrode 124*e*. A control terminal electrode 124*e*, an input terminal electrode 173*e*, and an output terminal electrode 175*e* along with a semiconductor 154*e* form a switching transistor $Q_{S3}$ having a channel in the semiconductor 154*e* disposed between the input terminal electrode 173*e* and the output terminal electrode 175*e*.

A pair of an input terminal electrode 173*f* and an output terminal electrode 175*f* are separated from each other and disposed opposite each other with respect to a control terminal electrode 124*f*. A control terminal electrodes 124*f*, an input terminal electrodes 173*f*, and an output terminal electrodes 175*f* along with a semiconductor 154*f* form a driving transistor $Q_d$ having a channel in the semiconductor 154*f* disposed between the input terminal electrode 173*f* and the output terminal electrode 175*f*.

Hereinafter, the data lines 171, the driving voltage line 172, the sensing lines 176, the input terminal electrodes 173*b*, 173*c*, 173*d* and 173*f*, and the output terminal electrodes 175*a*, 175*c*, 175*d*, 175*e* and 175*f* are referred to as a data wire.

The data wire 171, 172, 176, 173*b*, 173*c*, 173*d*, 173*f*, 175*a*, 175*c*, 175*d*, 175*e* and 175*f* are preferably made of refractory metal such as Cr, Mo, Ti, Ta or alloys thereof. However, they may also have a multilayered structure including a low-resistivity film (not shown) and a good-contact film (not shown). A good example of the combination is a lower Mo film, an intermediate Al film, and an upper Mo film as well as the above-described combinations of a lower Cr film and an upper Al—Nd alloy film and a lower Al film and an upper Mo film.

Like the gate wire 121, 122, 123, 124*c* and 124*f*, the data wire 171, 172, 176, 173*b*, 173*c*, 173*d*, 173*f*, 175*a*, 175*c*, 175*d*, 175*e* and 175*f* have tapered lateral sides, and the inclination angles thereof range about 30-80 degrees.

A passivation layer 180 is formed on the data wire 171, 172, 176, 173*b*, 173*c*, 173*d*, 173*f*, 175*a*, 175*c*, 175*d*, 175*e* and 175*f* and exposed portions of the semiconductors 154*a*, 154*b*, 154*c*, 154*d*, 154*e* and 154*f*. The passivation layer 180 is preferably made of inorganic insulator such as silicon nitride or silicon oxide, organic insulator, or low dielectric insulating material having dielectric constant lower than 4.0 such as a-Si:C:O and a-Si:O:F formed by plasma enhanced chemical vapor deposition (PECVD). The passivation layer 180 may have photosensitivity and flatness. The passivation layer 180 may have a double-layered structure including a lower inorganic film and an upper organic film.

The passivation layer 180 has a plurality of contact holes 184, 182, 189, 187, 183 and 188 exposing the driving voltage line 172, the output terminal electrodes 175*a*, 175*d* and 175*f*, and the input terminal electrodes 173*c* and 173*d*. In addition, the passivation layer 180 and the gate insulating layer 140 have a plurality of contact holes 181*a*, 181*b*, 185, 186*a* and 186*b* exposing both ends of the control terminal electrodes 124*f*, the control terminal electrodes 124*c*, and the reverse bias voltage lines 122. The contact holes 181*a*-189 may be polygonal or circular and have sidewalls having inclination angle of about 30-85° or stepwise sidewalls.

A plurality of pixel electrodes 190 and a plurality of connections 191, 192, 193, 194 and 195, which are preferably made of transparent conductor such as ITO or IZO or reflective conductor such as Ag or Al, are formed on the passivation layer 180.

The pixel electrodes 190 are physically and electrically connected to the output terminal electrodes 175*f* through the contact holes 187. In addition, the pixel electrodes 190 partly overlap the expansions 178, and the sensor capacitors $C_2$ are formed by the overlap of the pixel electrodes 190 and the expansions 178.

The connections 191 cross over the sensing lines 176 and are connected to the control terminal electrodes 124*f* and the output terminal electrodes 175*a* through the contact holes 181*a* and 182. The connections 192 cross over the data lines 171 and are connected to the input terminal electrodes 173*c* and the driving voltage lines 176 through the contact holes 183 and 184. The connections 193 cross over the inversion signal lines 123 and are connected to the control terminal electrodes 124*c* and the reverse bias voltage lines 122 through the contact holes 185 and 186*a*. The connections 194 are connected to the reverse bias voltage lines 122 and the input terminal electrodes 173*d* through the contact holes 186*b* and 188. The connections 195 cross over the reverse bias voltage lines 122 and the inversion signal lines 123 and are connected to the control terminal electrodes 124*f* and the output terminal electrodes 175*d* through the contact holes 181*b* and 189.

A partition 803 preferably made of inorganic or organic insulator is formed on the pixel electrodes 190, the connections 191-195, and the passivation layer 180. The partition 803 encloses the pixel electrodes 190 to define a plurality of depressions. The partition 803 may include photosensitive material including black pigment for blocking light leakage and simplifying the manufacturing process.

A plurality of organic light emitting members 70 are formed on the pixel electrode 190 and enclosed by the partition 803. The organic light emitting members 70 include organic material emitting red, green, or blue light and the red, green and blue colors are arranged in turn.

A buffer layer 804 is formed on the partition 803 and the organic light emitting member 70. The buffer layer 804 may be omitted if unnecessary.

A common electrode 270 supplied with a common voltage Vcom is formed on the buffer layer 804. The common electrode 270 is preferably made of transparent conductive material such as ITO or IZO. When the pixel electrode 190 is transparent, the common electrode 270 may be made of Ca, Ba, or Al.

A combination of opaque pixel electrodes 190 and a transparent common electrode 270 is employed to a top emission OLED that emits light toward the top of the display panel 300, and a combination of transparent pixel electrodes 190 and a opaque common electrode 270 is employed to a bottom emission OLED that emits light toward the bottom of the display panel 300.

A pixel electrode 190, an organic light emitting member 70, and a common electrode 270 form a light emitting element LD having the pixel electrode 190 as an anode, the common electrode 270 as a cathode or vice versa. The light emitting element LD uniquely emits one of three primary color lights depending on the material of the light emitting member and the display of images is realized by the addition of the three primary colors.

In the meantime, an auxiliary electrode (not shown) having low resistivity such as Al (alloy) may be provided for compensating the conductivity of the common electrode 270. The auxiliary electrode may be disposed between the common electrode 270 and the buffer layer 804 or on the common electrode 270 and it does not overlap the organic light emitting member 70 and may follow the lattice shape of the partition 803.

Now, a manufacturing method of the OLED shown in FIGS. 10-14 according to an embodiment of the present invention will be described in detail with reference to FIGS. 15-22 as well as FIGS. 10-14.

FIGS. 15, 17, 19 and 21 are layout views of the OLED shown in FIGS. 10-14 in intermediate steps of a manufacturing method thereof and FIGS. 16, 18, 20 and 22 are sectional view of the OLED shown in FIGS. 15, 17, 19 and 21 taken along the lines XVI-XVI', XVIII-XVIII', XX-XX', and XXII-XXII', respectively.

Figure 15:
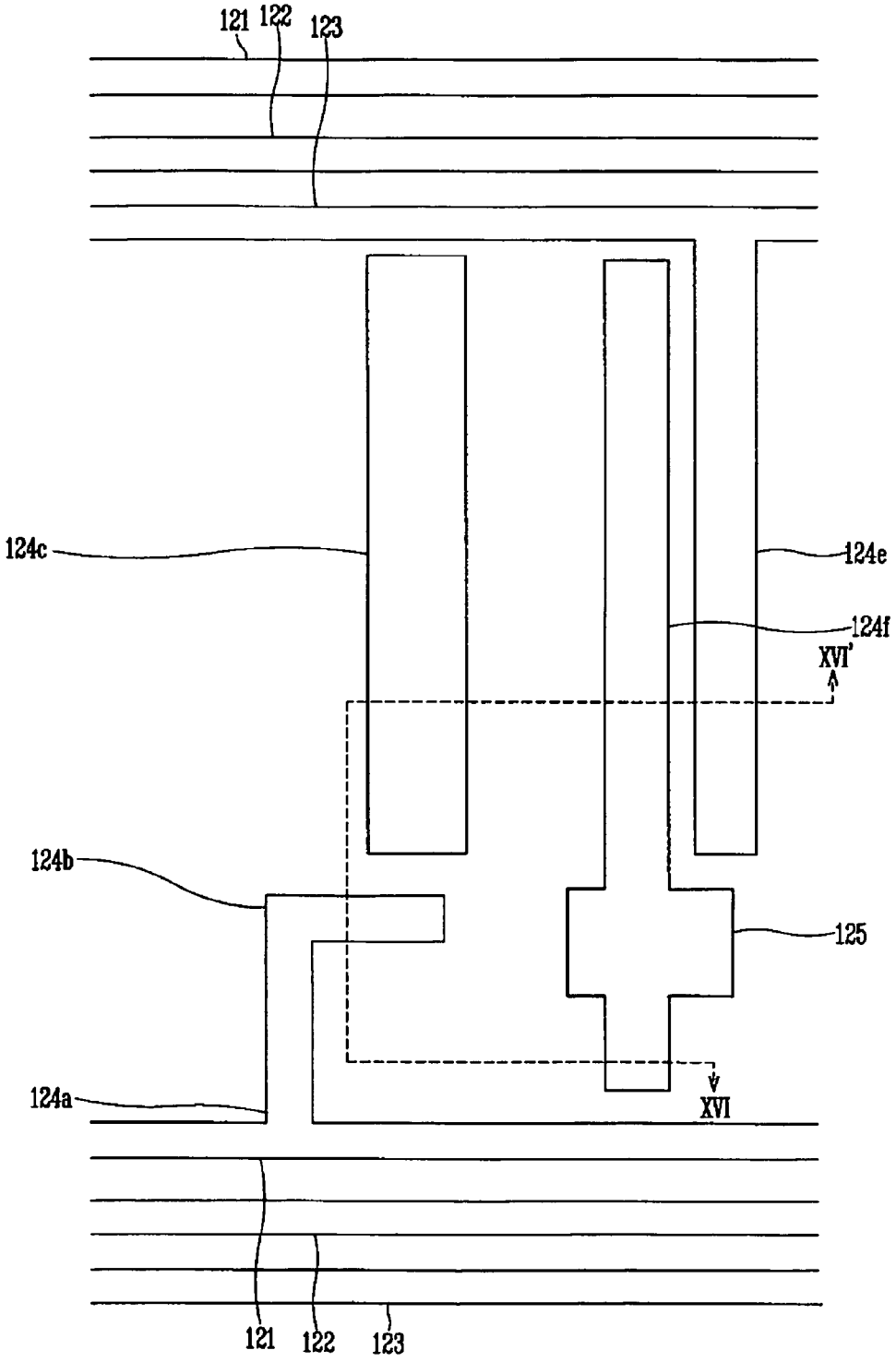
FIGS. 15, 17, 19 and 21 are layout views of the OLED shown in FIGS. 10-14 in intermediate steps of a manufacturing method thereof.
Figure 16:
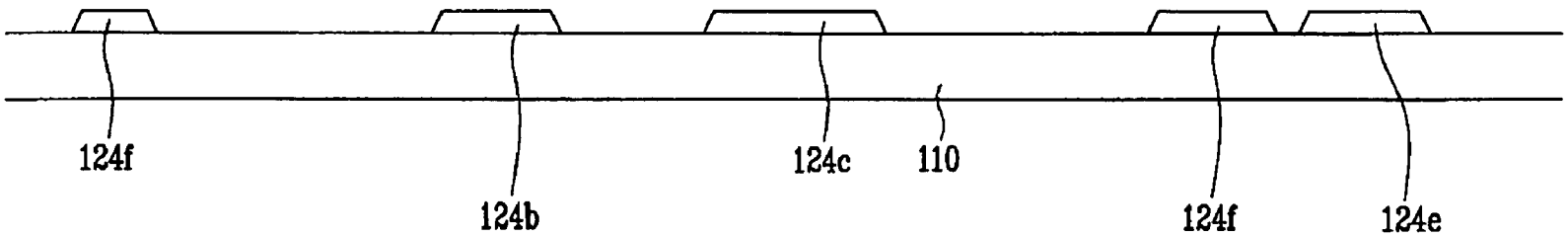
FIGS. 16, 18, 20 and 22 are sectional view of the OLED shown in FIGS. 15, 17, 19 and 21 taken along the lines XVI-XVI', XVIII-XVIII', XX-XX', and XXII-XXII', respectively.

Referring to FIGS. 15 and 16, a gate wire 121, 122, 123, 124*c* and 124*f* is formed on an insulating substrate 110.

Figure 17:
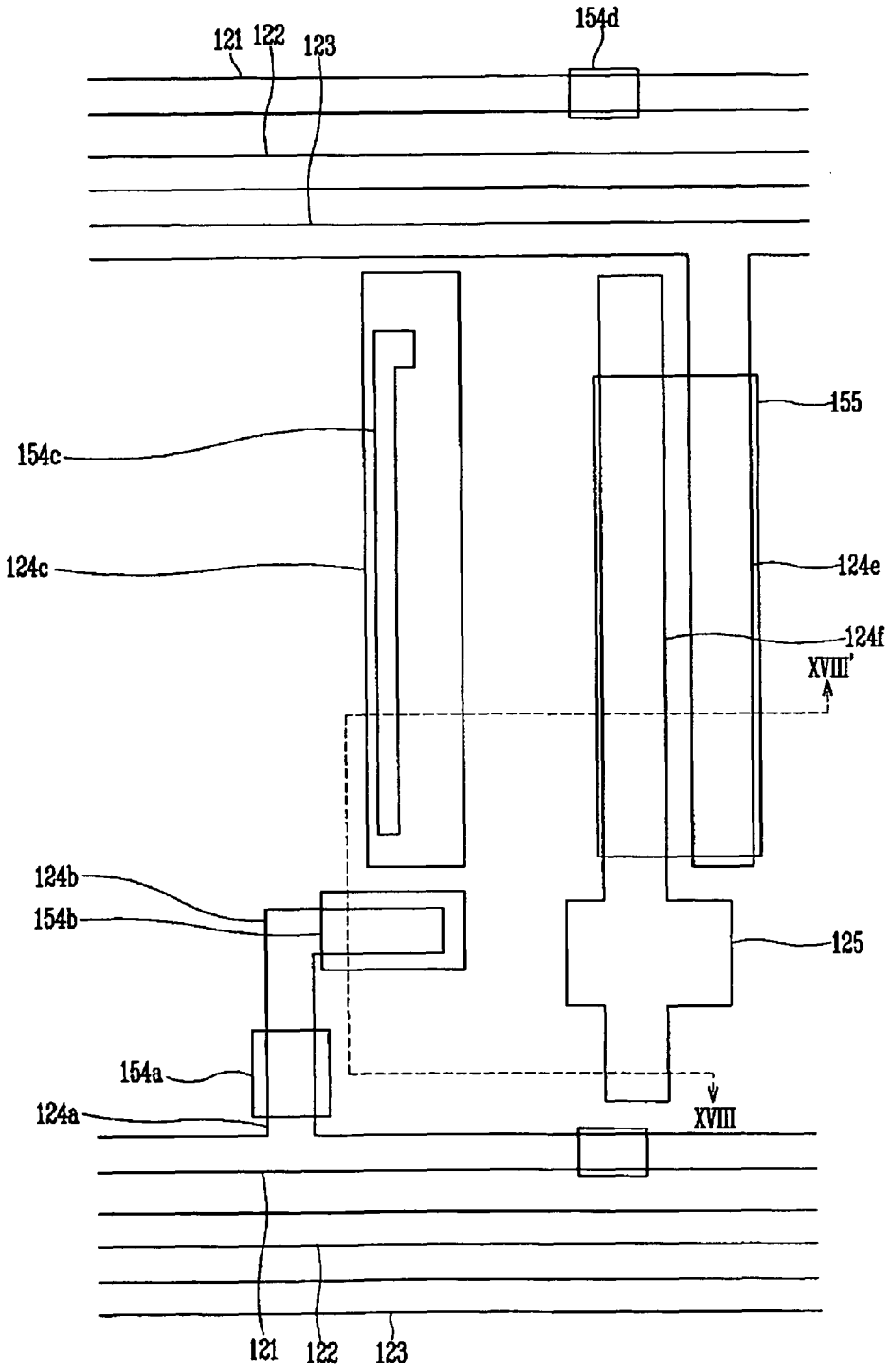
Figure 18:
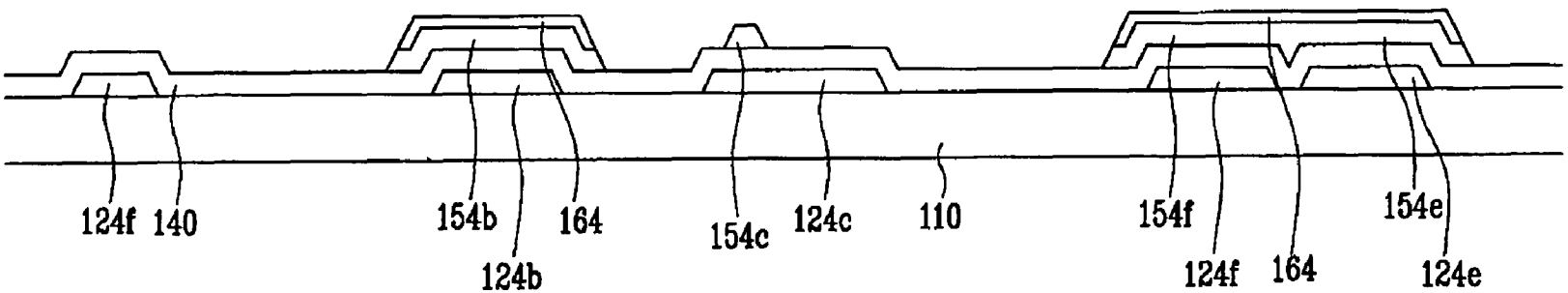

Referring to FIGS. 17 and 18, a gate insulating layer 140, an intrinsic a-Si layer 150, and an extrinsic a-Si layer 160 are sequentially deposited by low temperature chemical vapor deposition (LPCVD) or plasma enhanced chemical vapor deposition (PECVD) and the upper two layers are patterned to form a plurality of extrinsic semiconductors 164 and a plurality of semiconductors 154*a*, 154*b*, 154*c*, 154*d*, 154*e* and 154*f*.

Figure 19:
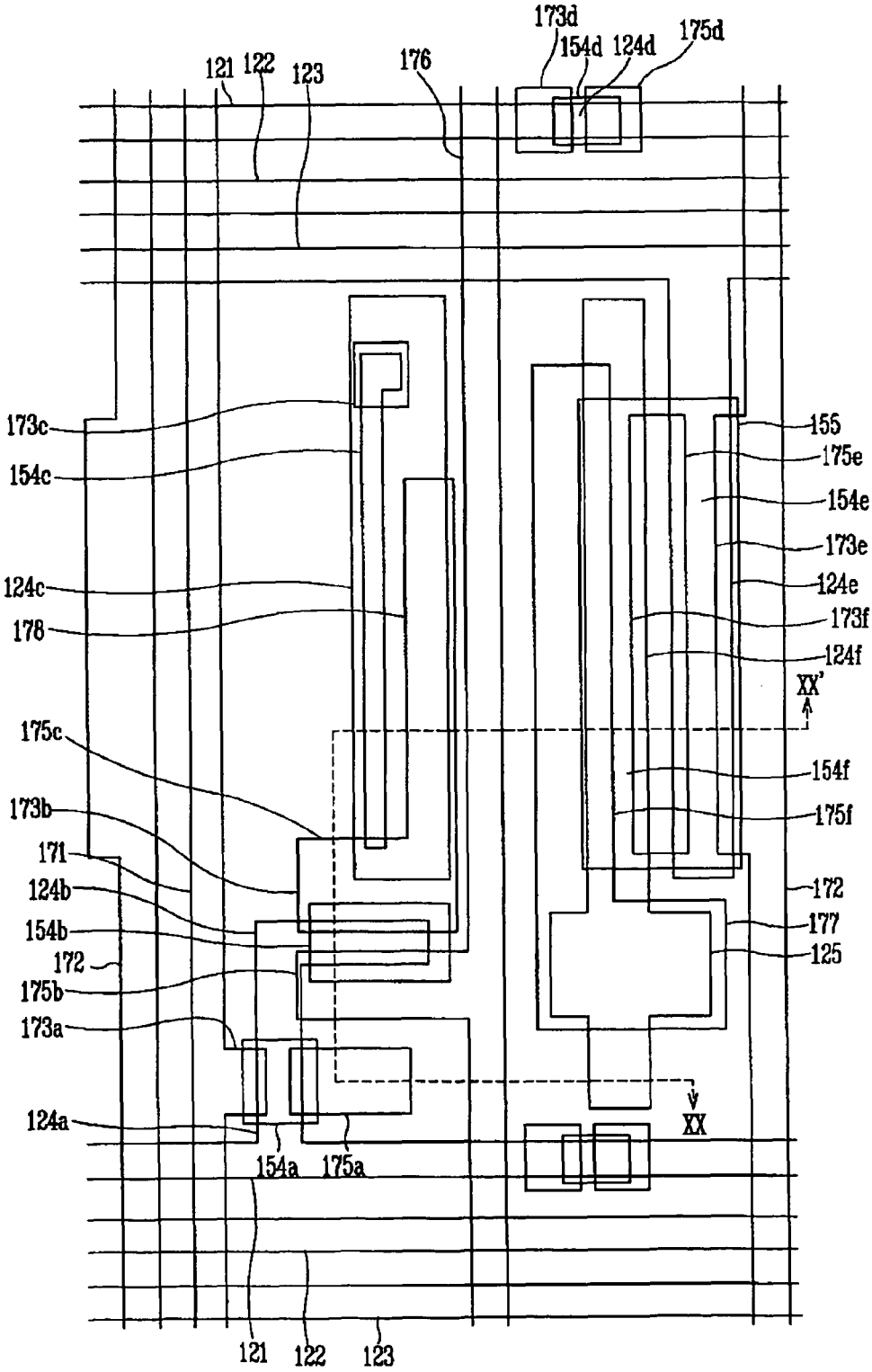
Figure 20:
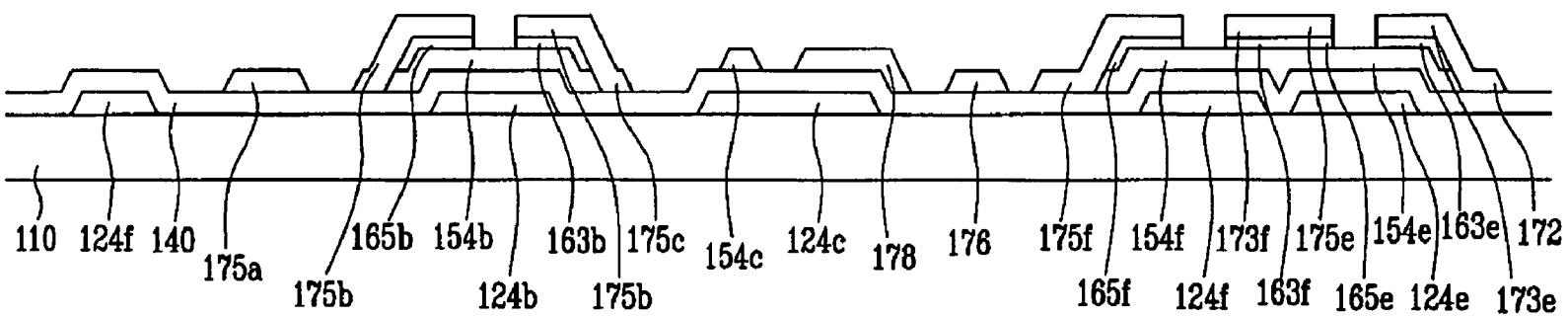

Referring to FIGS. 19 and 20, a data wire 171, 172, 176, 173*b*, 173*c*, 173*d*, 173*f*, 175*a*, 175*c*, 175*d*, 175*e* and 175*f* is formed and exposed portions of the extrinsic semiconductors 164 to form a plurality of ohmic contacts 163*a*, 163*b*, 163*c*, 163*d*, 163*e*, 163*f*, 165*a*, 165*b*, 165*c*, 165*d*, 165*e* and 165*f*.

Figure 21:
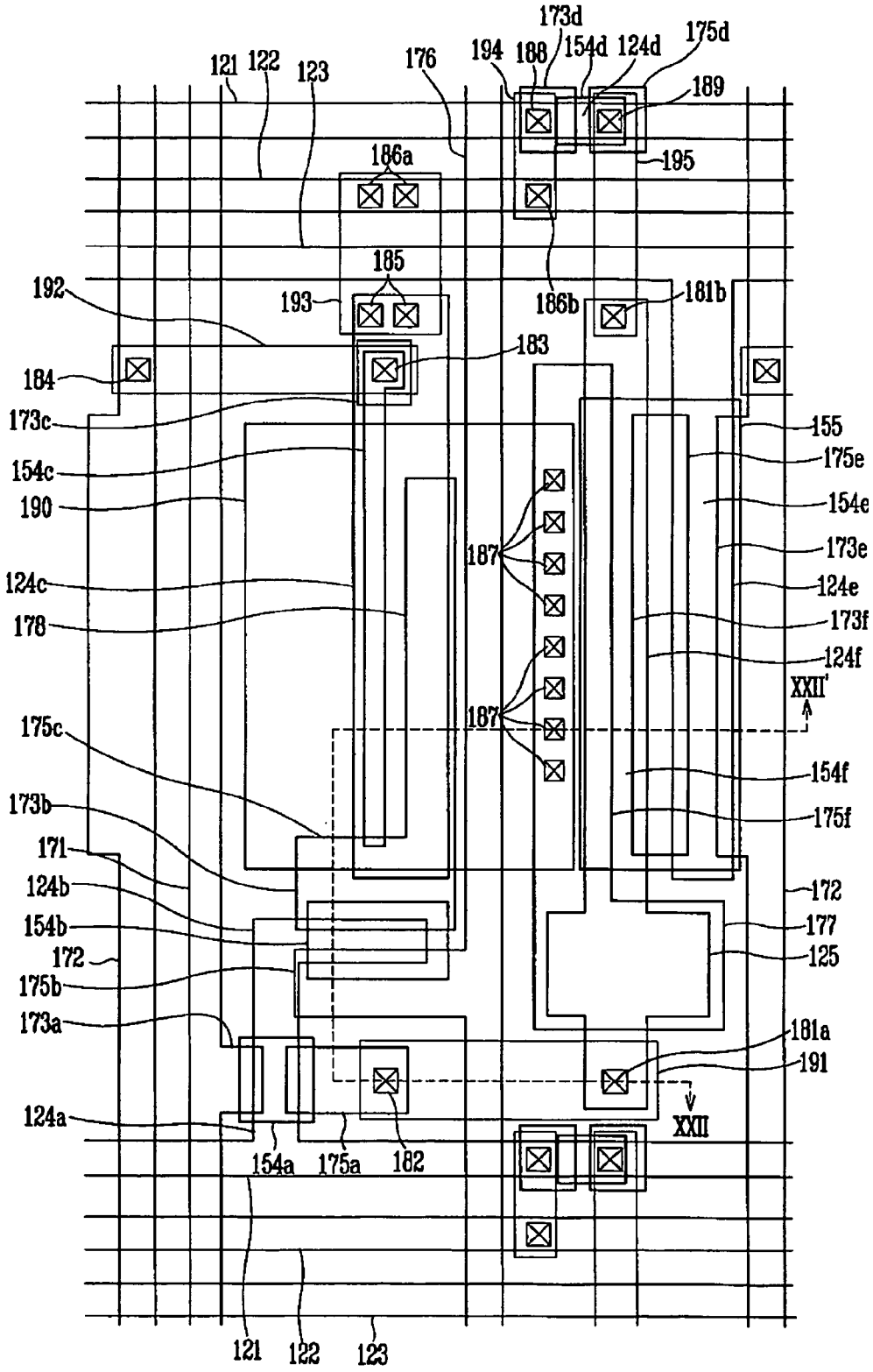
Figure 22:
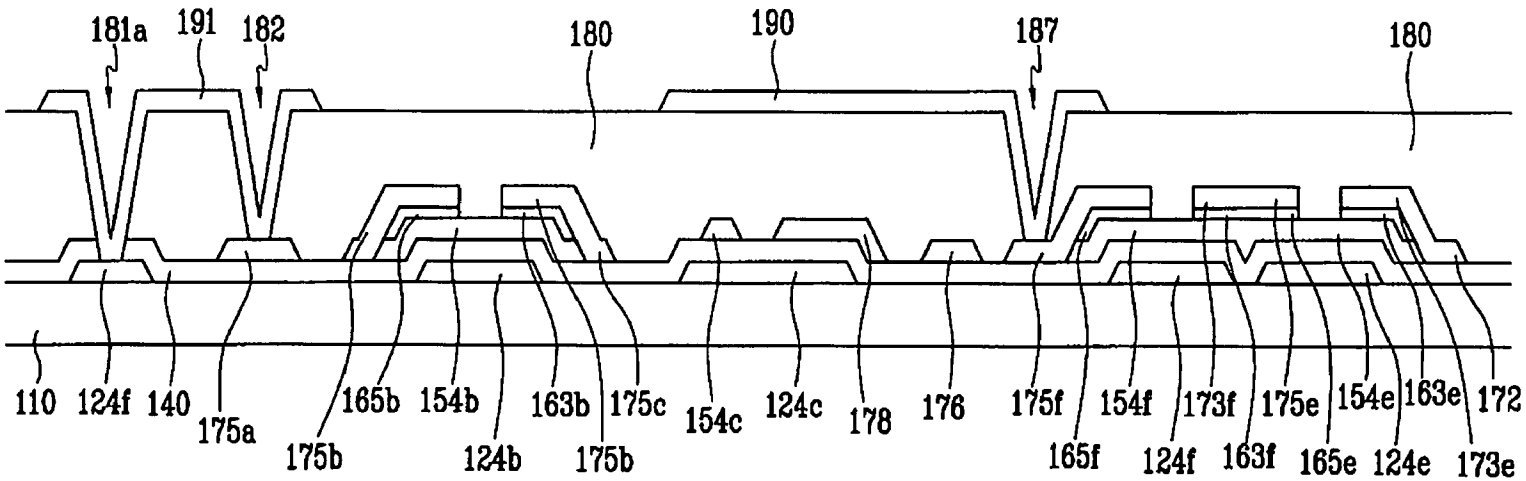

Referring to FIGS. 21 and 22, a passivation layer 180 is deposited and patterned to form a plurality of contact holes 181*a*-189. When the passivation layer 180 has photosensitivity, a photolithography step without an etching step is sufficient for forming the contact holes 181*a*-189.

Next, a plurality of pixel electrodes 190 and a plurality of connections 191-195 are formed on the passivation layer 180.

Figure 12:
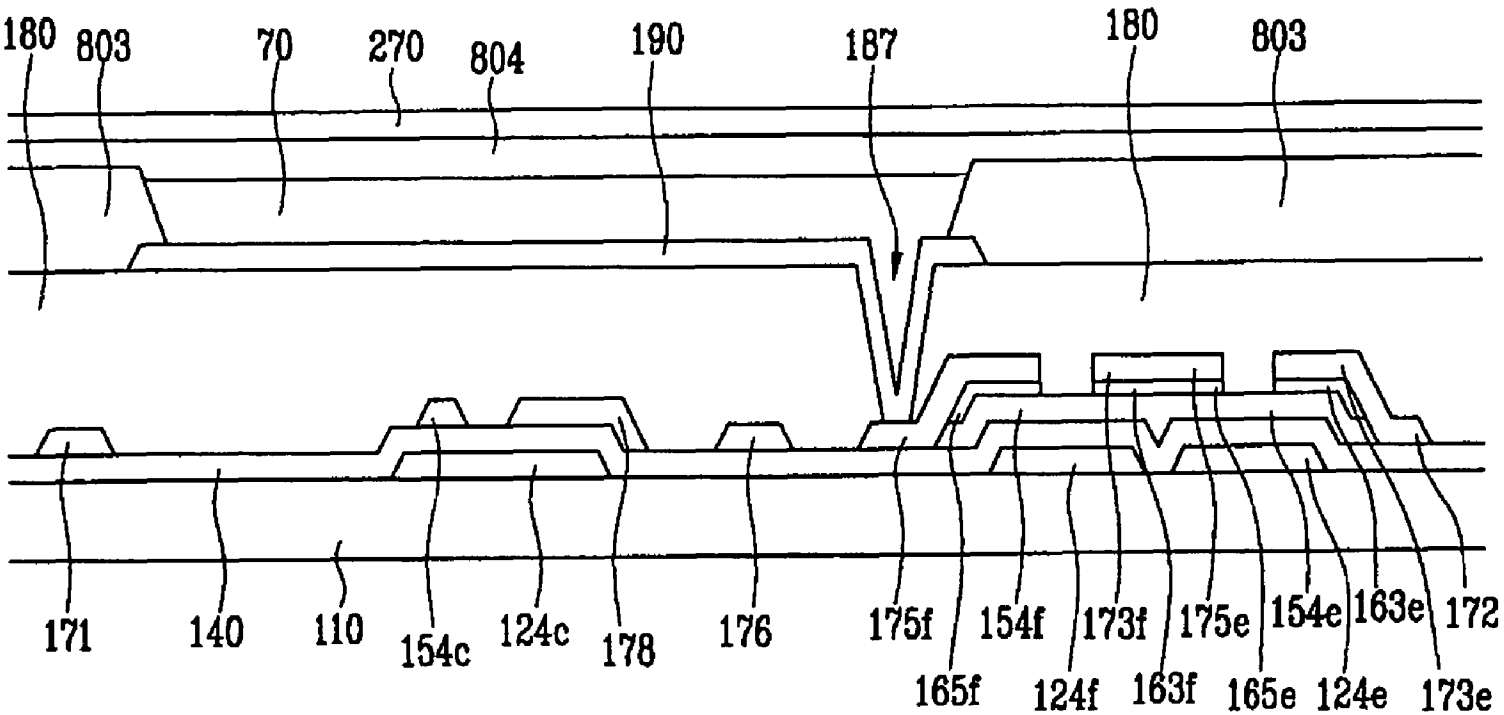
Figure 13:
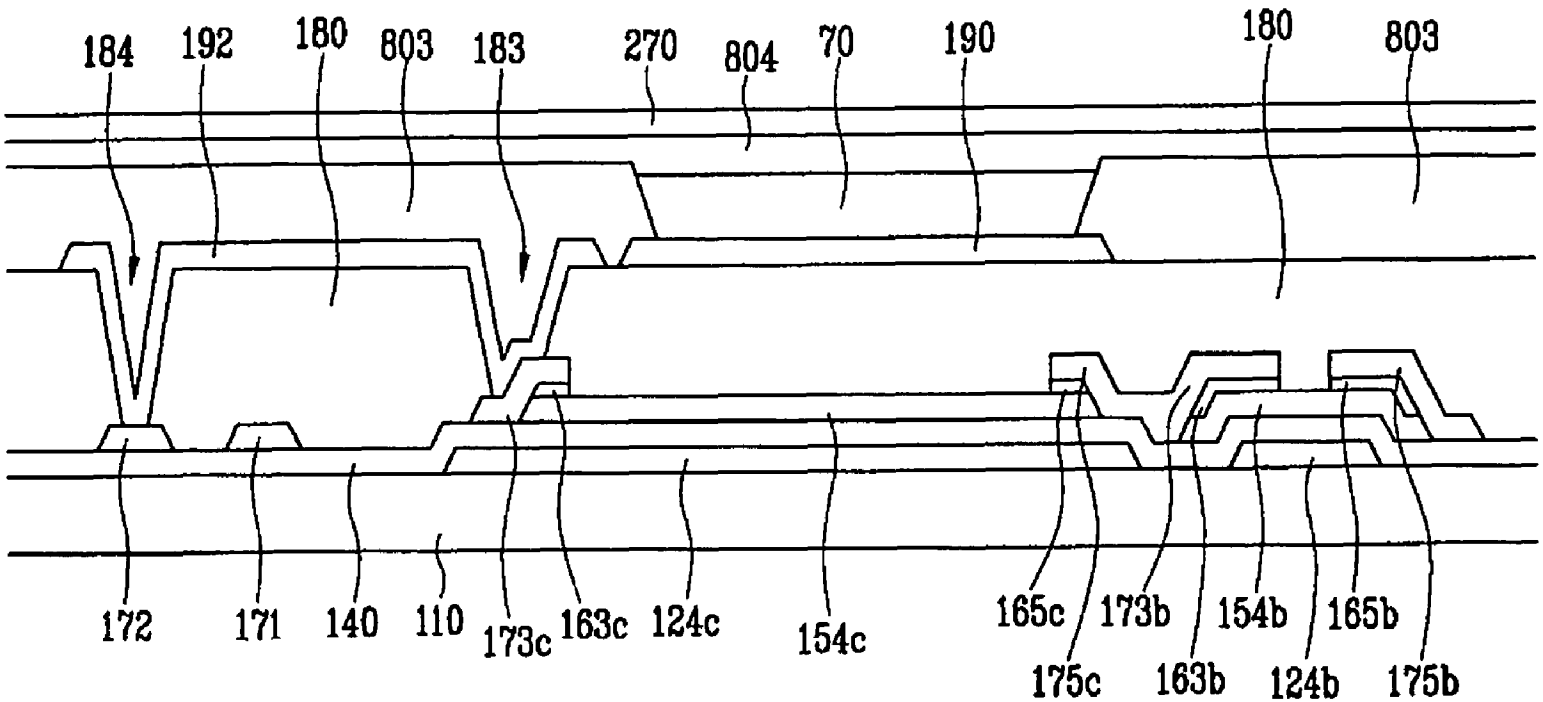
Figure 14:
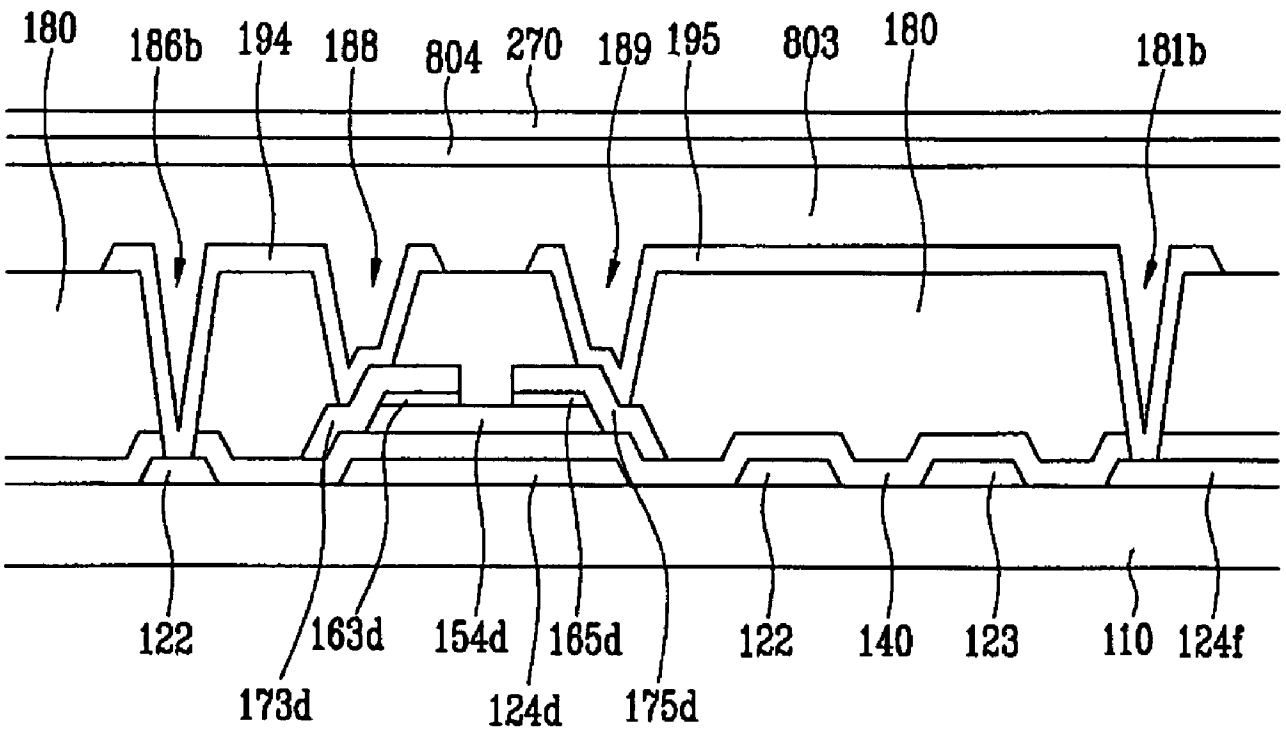

Referring to FIGS. 10 and 12, an organic film containing black pigment is coated and patterned to form a partition 803. When the organic film has photosensitivity, a photolithography step without an etching step is sufficient for forming the partition 803.

A plurality of organic light emitting members 70 are formed on the pixel electrodes 190. The organic light emitting members 70 may include multi layers and formed by masking and deposition or by ink jet printing.

Subsequently, a conductive organic material is deposited on the organic light emitting members 70 to form a buffer layer 804, and a common electrode 270 is formed on the buffer layer 804.

As described above, the application of the reverse bias voltage before the application of the data voltage improves the stability of the driving transistor. In addition, the disconnection of the driving transistor from the driving voltage $V_{dd}$ during the writing of the data voltage into the driving transistor may prevent the decrease of the dynamic range of the control voltage. Furthermore, the modification of the image signals based on the sensed luminance enables to maintain uniform luminance regardless of the variation or change of the characteristics of the driving transistor and the light emitting element.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A display device comprising:

a light emitting element;

a storage capacitor;

a driving transistor which has a control terminal and supplies a driving current to the light emitting element to emit light;

a first switching transistor which applies a data voltage to the control terminal of the driving transistor and the storage capacitor in response to a first gate scanning signal, a light sensor which senses an amount of light according to the light emitted from the light emitting element and generates a sensing signal depending on the sensed light amount;

a signal controller which determines a luminance corresponding to the sensing signal, compares the determined luminance and a target luminance corresponding to the data voltage, and modifies an image signal;

a second switching transistor which applies a reverse bias voltage to the control terminal of the driving transistor and the capacitor in response to a second gate scanning signal before the data voltage is applied to the driving transistor;

a third switching transistor which connects the driving transistor to a driving voltage according to an inversion signal during the application of the data voltage to the driving transistor; and an inversion unit which comprises:

a first transistor having a control terminal and an input terminal that are connected to a gate-on voltage and an output terminal connected to the third switching transistor; and a second transistor having a control terminal connected to the first gate scanning signal, an input terminal connected to the second gate scanning signal, and an output terminal connected to the third switching transistor, wherein an on-pulse of the second gate scanning signal applied to the second switching transistor occurs prior to an on-pulse of the first gate scanning signal applied to the first switching transistor.

2. The display device of claim 1, wherein the inversion unit applies the inversion signal to the third switching transistor, and wherein a level of the inversion signal is reversed with respect to a level of the first gate scanning signal.

3. The display device of claim 1, further comprising first and second scanning signal lines transmitting the first and the second gate scanning signals, respectively, wherein the second scanning signal line is previous to the first scanning signal line.

4. The display device of claim 3, wherein the first and the second gate scanning signals comprise a plurality of gate-on voltages.

5. The display device of claim 3, wherein the reverse bias voltage has negative polarity.

6. The display device of claim 1, wherein the light sensing unit comprises:

a sensing transistor sensing amount of light according to the light emission of the light emitting element and generating photo current; and a fourth switching transistor outputting a sensing signal according to the photo current.

7. The display device of claim 6, wherein the fourth switching transistor outputs the sensing signal in response to the first gate scanning signal.

8. The display device of claim 6, wherein the light sensing unit further comprises a sensor capacitor storing electrical charges depending on the photo current to generate the sensing signal.

9. The display device of claim 1, wherein the signal controller comprises:

a lookup table storing luminance information corresponding to the sensing signal; and a data modifier reading the luminance information from the lookup table to determine the luminance corresponding to the sensing signal, comparing the determined luminance and a target luminance corresponding to the data voltage, and modifies an image signal.

10. The display device of claim 9, wherein the data modifier increases the data voltage when the determined luminance is lower than the target luminance and decreases the data voltage when the determined luminance is higher than the target luminance.

11. The display device of claim 10, wherein the driving current increases as the data voltage increases, and the driving current decreases as the data voltage decreases.

12. The display device of claim 1, wherein the first switching transistor and the driving transistor comprise amorphous silicon thin film transistors.

13. The display device of claim 1, wherein the first switching transistor and the driving transistor comprise nMOS thin film transistors.

14. The display device of claim 1, wherein the light emitting element comprises a light emitting layer.

15. A display device comprising:

a light emitting element;

a driving transistor having a first terminal, a second terminal connected to the light emitting element, and a control terminal;

a capacitor connected between the second terminal and the control terminal of the driving transistor;

a sensing element generating photo current according to light emission of the light emitting element;

a first switching element operating in response to a first scanning signal and connected between the control terminal of the driving transistor and a data line and transmitting a data voltage from the data line to the driving transistor;

a second switching element operating in response to a second scanning signal and connected between the control terminal of the driving transistor and a reverse bias voltage line and transmitting a second voltage from the reverse bias voltage line to the driving transistor;

a third switching element operating in response to a third scanning signal and connected between the first terminal of the driving transistor and driving voltage line and connecting the driving transistor to the driving voltage line;

a fourth switching element operating in response to the first scanning signal and outputting a sensing signal according to the photo current.

16. The display device of claim 15, further comprising:

an inversion unit including first and second transistors and generating the third scanning signal, wherein the first transistor has a control terminal and an input terminal connected to a gate-on voltage and an input terminal connected to the third switching element, and the second transistor has a control terminal connected to the first scanning signal, an input terminal connected to the second scanning signal, and an output terminal connected to the third switching element.

17. A method of driving a display device including a light emitting element, a driving transistor having a control terminal and connected to the light emitting element, and a capacitor connected to the driving transistor and the light emitting element, the method comprising:

applying a data voltage to the control terminal of the driving transistor and the capacitor in response to a first gate scanning signal;

supplying a driving current to the light emitting element through the driving transistor according to the data voltage to emit light;

generating a sensing signal according to the light emission of the light emitting element;

modifying image signals by determining luminance corresponding to the sensing signal and comparing the determined luminance and a target luminance;

applying a reverse bias voltage to the control terminal of the driving transistor in response to a second gate scanning signal, wherein an on-pulse of the second gate scanning signal applied to a second switching transistor occurs prior to an on-pulse of a first gate scanning signal applied to a first switching transistor; and selectively connecting the driving transistor to a driving voltage, wherein the display device comprises:

a third switching transistor which connects the driving transistor to a driving voltage according to an inversion signal during the application of the data voltage to the driving transistor; and an inversion unit which comprises:

a first transistor having a control terminal and an input terminal that are connected to a gate-on voltage and an output terminal connected to the third switching transistor; and a second transistor having a control terminal connected to the first gate scanning signal, an input terminal connected to the second gate scanning signal, and an output terminal connected to the third switching transistor.

18. The method of claim 17, wherein the selective connection comprises:

disconnecting the driving transistor from the driving voltage when the data voltage is applied to the driving transistor and the capacitor; and connecting the driving transistor to the driving voltage when the data voltage is not applied to the driving transistor and the capacitor.

19. The method of claim 17, wherein the modification comprises:

increasing the data voltage when the determined luminance is lower than the target luminance; and decreasing the data voltage when the determined luminance is higher than the target luminance.

* * * * *